US006257624B1

(12) United States Patent
Fabel

(10) Patent No.: US 6,257,624 B1
(45) **Date of Patent: *Jul. 10, 2001**

(54) SINGLE SIDE IMAGED POSTAL FORM ASSEMBLY

(75) Inventor: Warren M. Fabel, Delray Beach, FL (US)

(73) Assignee: Laser Substrates, INC, Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/102,852

(22) Filed: Jun. 23, 1998

Related U.S. Application Data

(63) Continuation-in-part of application No. 08/049,946, filed on Apr. 20, 1993, and a continuation-in-part of application No. 09/097,246, filed on Apr. 12, 1998.

(60) Provisional application No. 60/087,595, filed on Jun. 1, 1998.

(51) Int. Cl.[7] ..... B42D 15/02

(52) U.S. Cl. ..... 283/62; 402/79; 283/61; 283/116; 462/19; 462/25; 462/26

(58) Field of Search ..... 402/79; 283/61, 283/62, 116; 462/19, 25, 26

(56) References Cited

U.S. PATENT DOCUMENTS

| | | | | |
|---|---|---|---|---|
| 3,111,449 | * | 11/1963 | Gold et al. | 428/192 |
| 4,418,865 | | 12/1983 | Bowen . | |
| 4,682,793 | | 7/1987 | Walz . | |
| 4,865,669 | | 9/1989 | Schmidt . | |
| 4,885,198 | | 12/1989 | Kimura . | |
| 5,173,081 | | 12/1992 | Greig . | |
| 5,183,203 | | 2/1993 | Sanders . | |
| 5,501,393 | | 3/1996 | Walz . | |
| 5,573,277 | | 11/1996 | Petkovsek . | |
| 5,664,725 | | 9/1997 | Walz . | |
| 5,697,648 | | 12/1997 | Petkovsek . | |
| 5,746,450 | | 5/1998 | Petkovsek . | |
| 5,836,622 | * | 11/1998 | Fabel | 283/62 |

FOREIGN PATENT DOCUMENTS

| | | |
|---|---|---|
| 0007398 | 1/1991 | (JP) . |

* cited by examiner

*Primary Examiner*—Daniel W. Howell
*Assistant Examiner*—Mark T. Henderson
(74) *Attorney, Agent, or Firm*—Ted W. Whitlock

(57) ABSTRACT

A form for creating a postcard having printing on both sides includes a front sheet and a back sheet, which are laminated using a pressure sensitive adhesive on a back surface of the front sheet. A fold line extends across the front sheet, while a tear line underlying the fold line extends across the back sheet. A gap in the adhesive preferably extends along the fold line. On one side of the fold line opposite to the direction of the gap, the inner surface of the back sheet has a release coating restricting the adhesion of the adhesive layer. After printing on the front surface of the front sheet, the section of the back sheet having this release coating is removed and discarded, and the front sheet is folded along the fold line, thereby providing a document having printing on both sides and a thickness sufficient for a postcard.

18 Claims, 26 Drawing Sheets

SINGLE SIDE IMAGED POSTAL FORM ASSEMBLY

CROSS REFERENCE TO RELATED APPLICATIONS

This is a continuation-in-part of U.S. patent application Ser. No. 08/049,946, filed Apr. 20, 1993; U.S. patent application Ser. No. 60/087,595, filed Jun. 1, 1998 and U.S. patent application Ser. No. 09/097,246, filed Jun. 12, 1998.

BACKGROUND OF THE INVENTION

1. Field of the Invention

This invention relates to postal forms which, having an image placed on a single side thereof, can be folded in a particular way to provide a double sided image, and more particularly, to means for generating, from a single form printed on a single side, various documents for sending certified, priority, registered, or other mail.

2. Background Information

Many types of specialized business forms are made for use with the impact printing process, which is available using a typewriter or any of a number of printers using raised type or wire matrices. These printing processes are characterized by an ability to generate multiple copies through the use of carbon paper between copies, or through the alternative use of other micro-encapsulated materials sensitive to pressure and impact. Many of the impact printers are configured to accept continuous forms with holes along the edges for feeding by means of a pin feed mechanism. Typewriters accept individual sheets of paper, while a number of modern low to medium speed printers accept both continuous forms with edge holes and individual sheets. number of forms include multiple sheets, or plies, affixed together to take advantage of the ability of the impact printing process to make multiple copies with a single pass through the printer. An example of this type of form is described in U.S. Pat. No. 4,682,793, issued to Gerard F. Walz on Jul. 28, 1987 and entitled "Multi-Part Mailer Form Assembly".

The increased use in most offices of non-impact printing devices, such as laser or ink jet printers, has led to a need to provide the capabilities commonly associated with impact printer forms, that is, the ability to use specialized multipart forms. This need is particularly important, since non-impact printers, with their greater flexibility in providing different type fonts and graphics capabilities, higher throughput, lower operating costs, and much better print quality, as well as reduced noise, are replacing impact printers in most offices. Thus, people needing the advantages provided by impact printers for specialized forms are not able to fulfill their needs because of the lack of an impact printer.

Non-impact printers are currently limited by an ability to print only on a single side of one sheet of paper at a given time. While it is possible to turn the paper over to be run through the printer again, to thereby print on both sides, automated devices which accomplish this function are not commonly available with conventional office non-impact printers found in most offices. Even if one could print on both sides of the form by manually feeding the same form again, this practice eliminates batching, whereby a large number of blank forms are placed in a paper feeding tray and all forms are produced at one time. addition, U.S. Postal Services requires that certain indicia and facing identification marks (FIMs) be placed at the edge of the page, form, or postcard, or that the indicia is placed less than ¼ inch, typically about ⅛ inch, from the edge. Non-impact printers will print only ¼ inch or more from the edge of a page passed therethrough. Thus, the use of non-impact printers with standard forms cannot meet U.S. Postal Service standards.

One of the other advantages of impact printing, particularly those impact printers using pin feed paper handling mechanisms, is the ability to print on paper stocks of significantly different thicknesses. For example, conventional paper stock has thicknesses of about 0.003 to 0.0035 inch. Post cards required by the U.S. Postal Service have a thickness of between 0.007 inch and 0.0095 inches. However, feeding a relatively thick card stock through a conventional office non-impact printer may cause problems with the paper handling mechanisms and as well as with the copy quality. Thus, many existing forms, such as the last sheet of the form described in U.S. Pat. No. 4,682,793 to Walz, which has a thickness within the range of a standard postcard, cannot be used with non-impact printers. Thus, many documents designed to be sent through the mail as postcards, such as is needed for certified or registered mail, cannot be automatically generated with modern office non-impact printers.

SUMMARY OF THE INVENTION

In accordance with one aspect of the invention, there is provided an assembly for providing a mailing document having images formed on both sides thereof, following a single pass through an image forming device which places an image on one side of the assembly.

In one embodiment of the subject invention, the assembly has a front sheet with an image receiving surface and an adhesive coated surface. In addition, the assembly has a back sheet having a first tear line between interior and facing surfaces. The interior surface is affixed to the adhesive coated surface of the front sheet such that a permanent bond is formed on one side of the tear line and a releasable bond is formed on the other side of the tear line. In addition, the assembly has a fold line on the front sheet aligned with the tear line when the front sheet and back sheet are affixed. This embodiment is preferably used for registered or certified mail.

In another embodiment of the subject invention, there is provided an assembly having a front sheet and a back sheet superimposed onto one another to form a laminated assembly, having a top, middle, and bottom section. Preferably, the sections of the assembly are formed as three consecutive sections comprising a top, middle, and bottom section, respectively corresponding to a mailing label, a first side of a confirmation form, and a second side of a confirmation form. The first and second sides of the confirmation form can be folded at a fold line therebetween and superimposed onto one another to form a duplex confirmation form.

The front sheet has a front image receiving face and an inner face facing the back sheet in the laminated configuration. In one embodiment, the inner surface of the front sheet can be coated with an adhesive in a particular pattern ("patterned adhesive") to provide adhesive at specific locations for adhering portions of the form to a surface. The inner surface of the front sheet can also include an adhesive-release material coated thereon in a particular pattern ("patterned release") to provide at a desired location a releasable bond between a face having adhesive coated thereon and a face contacting the adhesive-coated face.

For example, the back face of the front sheet can have at least one small strip of release material coated on an area of the bottom section which, when its back face is folded to meet the back face of the middle section, as in its typical operation, forms a releasable strip which, when removed, exposes adhesive on the front face of the front sheet, now folded such that it is a back face of the assembly, so that the confirmation form can be affixed to the mailing piece. Several embodiments of this affixing strip are contemplated, including an embodiment wherein two releasable strips are formed on opposite sides of the confirmation form, or where no strips are formed and the confirmation card can be attached to the mail piece and is retained only by its connection at the perforation lines to the top section.

This embodiment further comprises a back sheet having a front and back face whereon a patterned adhesive release material can be coated on at least one face in particular areas to form a releasable bond when contacting an adhesive-coated face. The front face of the back sheet, which contacts the front sheet, has adhesive release material substantially on the top and middle sections.

In a preferred embodiment, the front sheet is formed as a plurality of separable sections and comprises a peel-away border along at least one edge of said front sheet. This peel-away border advantageously provides a margin along at least one edge of the assembly, wherein the margin extends from the edge of a section so that mailing or other information can be printed less than one-quarter inch from, e.g., flush with, the edge of the sections. The capability to print flush with the edge of a section enables this mailing label to meet U.S. Postal Services standards which require certain indicia, e.g., a facing indicating mark (FIM), to be printed at ⅛ inch or less from the edge of an envelope or other mailing piece.

The back sheet preferably is die-cut or perforated to form sections which conform to the die-cuts or perforations of the front sheet so that fold lines, peelaway strips, or sections, and separable sections, correspond to the front sheet for proper operation of the assembly.

The sections are preferably divided by transverse perforations for either separating one from another or to facilitate folding along the perforation so the sections meet one another to form a duplex configuration as desired. Typically, when the assembly is used for priority mailing, the top section forms the addressee label, and the bottom two sections are folded over one another and adhered together to form a single duplex confirmation form section, e.g., Postal Form USPS 3849. The top, or mailing label, section, on which delivery information is printed, is adhered to the mailing piece. The bottom sections, in folded configuration to form a single duplex form, are either adhered to the mailing piece, or can be left unadhered to the mailing piece and affixed to the top section at a perforation line separating the top section from the second, or middle, section.

In use of this embodiment, the top face of the sections can be printed on by passing the unfolded assembly through a non-impact printer. For proper placement on the mail piece, adhesive is exposed on one of the middle or bottom sections of the front sheet by peeling away the corresponding section of the back sheet, and the confirmation card is formed by folding the bottom section to meet and adhere to the middle section. The top or mailing label section of the top sheet is peeled back from the top section of the back sheet, which also peels away a strip on the back of the folded confirmation form, i.e., providing a confirmation tab. The adhesive exposed top section of the front sheet and confirmation tab are then adhered in place on the mail piece. When the mail piece is delivered, the carrier can then remove the confirmation form from the mail piece, tearing along the preformed perforation or tear lines, leaving the confirmation tab and top section of the assembly adhered to the mail piece. The confirmation form can then be retained by the carrier for the mailing record.

In yet another embodiment of the subject invention, a two-ply laminated form for providing certified or registered mailing label taggants and confirmation forms is provided in a configuration such that the mailing labels, taggants, and confirmation forms are affixable as a single unit (hereinafter "the unitary embodiment") to an envelope. A "taggant" is well understood in the art to refer to a mailing identifier tag which is placed on an envelope to indicate special postal status i.e., certified mail, registered mail, or the like, and which carries the mailing article number.

The unitary embodiment of the subject mailing form comprises a front sheet having a front face comprising a plurality of discrete sections on which mailing information can be printed by a non-impact printer. Preferably, the mailing information can be printed on the front face of said front sheet in the particular discrete sections such that the sections can be folded over and superimposed onto one another or folded onto a face of an envelope and positioned in compliance with United States Postal Service (USPS) requirements. Connecting sections interdisposed between the discrete sections having mailing information or indicia printed thereon can be provided to keep the sections together as a single unit during affixation to the envelope and to provide proper spacing for affixing the mailing label or confirmation form sections onto the envelope in accordance with USPS requirements. In a preferred embodiment, the mailing label or mailing indicia sections are permanently affixed to an envelope, whereas the confirmation form or return receipt sections are removably affixed to the envelope.

The back face of the front sheet has adhesive material disposed substantially over its entire surface area, a gap area to facilitate forming a duplex confirmation form, and an approximately 1/16" border to prevent hot-melt adhesive from oozing out from the edges of the sheet during exposure of the form to heat from a laser printer. The patterned adhesive provides adhesive properties for certain sections which are superimposable over and permanently affixed to one another, e.g., forming of a duplex confirmation form, or sections or tabs which are permanently affixable to the envelope.

Adhesive release material is also patternly disposed on the back face of the front sheet. The patterned adhesive release material provides a releasable bond for removal or peeling away of certain sections of the front sheet relative to the back sheet.

The back sheet has a front, or inner, face which contacts the back face of the front sheet, and a back face on which instructional information can be printed. The front face of the back sheet can also have patternly disposed adhesive release material for forming a releasable bond with adhesive material disposed on a contacting sheet.

The unitary embodiment of the subject invention includes a first variation for providing certified mailing labels, a second variation for providing registered mailing labels, and other mailing forms. Both variations have a front sheet comprising a single, unseparable section on which mailing indicia and addressee information can be printed, a return receipt section, a confirmation form section which can be foldably formed into a duplex confirmation form, a section providing return address information, and a taggant. The sections are configured on the sheet such that the mailing indicia, address information, return address information, and mailing type indicator can be automatically correctly positioned on the envelope in accordance with USPS requirements. In a preferred embodiment, the back face of the front sheet includes a guide for placement of the envelope in a position such that the mailing labels and confirmation forms are correctly positioned on the envelope. In particular, the guide comprises a mark for aligning the envelope thereover such that the foldable mailing label, confirmation form or other sections having mailing information are properly positioned in accordance with the USPS standards.

This embodiment can further provide IBIP indicia ⅛" or less from the top edge of the envelope. More preferably, the IBIP information, e.g., FIM mark, can be positioned on the envelope flush with the top edge of said envelope. The subject invention assures accurate alignment of the IBIP indicia in accordance with USPS requirements.

In addition, the duplex confirmation form is releasably affixed on the back of said envelope in a manner so that it is easily removed, preferably along perforated tear-away lines, upon delivery of the envelope to the addressee. Further, the subject mailing form can be configured such that the taggant is properly positioned on the envelope in accordance with USPS requirements, e.g., at an appropriate position and overlapping the top edge of the envelope, which is required by the USPS to provide visual aid to the postal worker when viewing a stack of envelopes of mixed mailing types.

Die-cuts and perforation lines are selectively provided around the perimeters of the sections. Die-cuts are made in order to provide for removable, or peel-away, sections, and perforation lines are made to facilitate folding of sections onto one another or over the envelope, or to provide tear away lines for removing certain sections, e.g., confirmation form, as necessary.

A first variation of the unitary embodiment of the subject mailing form, adapted for certified mail use, comprises a receipt section positioned below and removably connected to the mailing indicia/addressee information section. This mailer's receipt is divided from the mailing indicia/addressee information section by a single perforation line disposed therebetween. A second variation of the subject mailing form, adapted for use with registered mail, comprises a double mailer's receipt section disposed below and connected to the mailing indicia/addressee section wherein the dual receipts are separable from one another by a perforation line. The perforation line dividing the return receipts can be vertically or horizontally disposed. This double return receipt thus provides one copy for Post Office records and a second copy for the mailer.

In operation of this embodiment, the form is fed through a non-impact printer to print mailing information and mailing indicia onto the front face of the front sheet of the form. A portion of the backing sheet is then removed to expose adhesive on the back face of a top section of the unfolded delivery confirmation form. The bottom section of the delivery confirmation form is then folded over and adhered to the exposed adhesive on the top confirmation form section to form a duplex delivery confirmation form or return receipt.

The balance of the backing sheet is then removed in a single step to expose adhesive disposed on the back face of the mailing indicia/addressee information section, the taggant/return address section, and tabs bordering the right and left edges of the duplex delivery confirmation form. The envelope can then be placed in a face-up position at the printed alignment guide so that the taggant/return address information and mailing indicia/addressee information sections can be folded over onto the front face of the envelope in conformance with USPS requirements. The mailer's receipt form, with the backing retained thereon, hangs freely at the bottom of the address information section for later removal.

Tabs adjacent to at least one side edge of the confirmation form remain affixed to the back side of said envelope upon separation and removal of the confirmation form along tear-away perforation lines along the right and left edges.

BRIEF DESCRIPTION OF THE DRAWINGS

Preferred embodiments of the subject invention are hereafter described with specific reference being made to the following Figures, in which.

DETAILED DESCRIPTION

Figure 1:
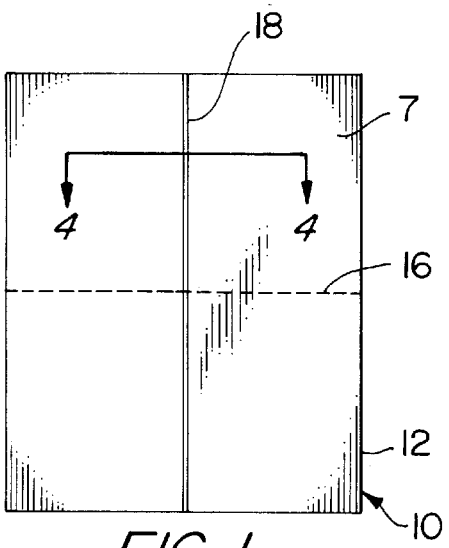
FIG. 1 is a front elevational view of a first embodiment of this invention.

The subject invention concerns various laminated assemblies useful as labels and confirmation receipts for mailing procedures. The laminates are adhered together in areas so as to retain the layers in a single form, and include areas where adhesive is absent or omitted, or include a release material which prevents permanent adherence with an adhesive-bearing surface.

For purposes of this invention, it would be understood that any acceptable adhesive used with paper products could be employed. Preferably, the subject laminated assemblies use pressure-sensitive adhesives which are well-known and commercially available.

Adhesive-release material , e.g., is also well-known and can include, in the preferred embodiments, a material coated on the assembly which reduces adherence when contacting an adhesive-coated surface. Alternatively, it would be understood that a material can be over-coated onto a particular area of the release material which eliminates the releasable property of the release material. This is commonly referred to in the art as using a "deadener" to allow for adherence. It would also be understood that the "deadener" can be a physical barrier, e.g., an adhesive cover, such as a layer of paper material which remains over an adhesive to allow for adherence.

In addition, the paper stock can be conventional or commercially available paper for use as a substrate. Preferably, in the subject assemblies, paper stock known in the art as REPAP (Interlake Papers, a division of Consolidated Papers, Inc., Des Plaines, Ill.), which is a matte or dull-coated stock can be used. This matte or dull-coated stock can advantageously inhibit absorbance of a liquid adhesive or adhesive-release material into the paper prior to "curing" of the adhesive or adhesive-release material. This inhibition of liquid absorbance is commonly known as "holdout". Typically, these materials are layered or coated onto a substrate in liquid form and then subjected to ultraviolet energy, e.g., UV light, to solidify the adhesive. Premature adherence is prevented by forming the solid phase of the adhesion. These procedures are well known in this art.

In a preferred embodiment, the adhesive can be a hot-melt adhesive as is well known in the art. In this embodiment, the hot-melt adhesive is applied to the substrate and the substrate is then passed over a chill-roller to congeal the hot-melt adhesive. A chill-roller is well known in the art to refer to a roller having a reduced temperature, typically by running a cooled or chilled liquid through its walls or core to transfer heat from the substrate passed thereover.

FIGS. 1 through 4 show the details of construction of a first embodiment of this invention, which provides a means for generating two postcards from a single form 10. Form 10 is preferably of a size which can be conveniently fed through a standard image forming device, such as a standard impact or non-impact printer commonly found in many offices, either as a single document, or as a stack of documents from which a number of postcards will be made. Form 10 is constructed by laminating a the interior facing side 8 of a front sheet 12 to the interior facing side 9 of a back sheet 14. Sheets 12 and 14 may be made by applying adhesive and release material coatings to various types of paper stocks, which are preferably of ordinary thickness, about 0.003 inch. While paper is preferably used for sheets other materials capable of receiving printed images and capable of adhesive attachment can be used as well.

Figure 2:
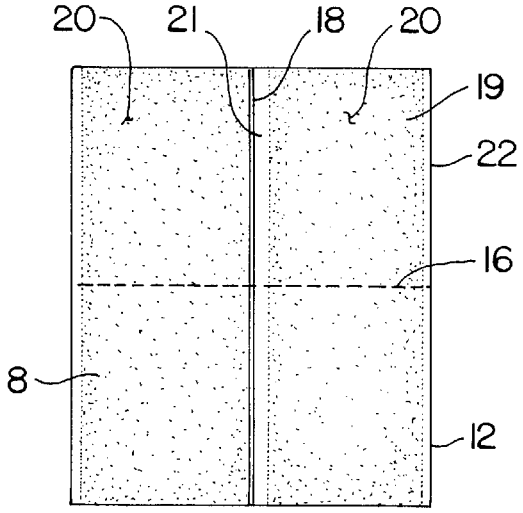
FIG. 2 is a rear elevational view of a front sheet in the embodiment of FIG. 1.

FIG. 1 shows a front view of form 10 and of the image receiving surface 7 of front sheet 12, which is divided into two fold line 18 is also applied to facilitate the proper folding of the form into two postcards. FIG. 2 shows a view of the interior facing side of front sheet 12, indicating two adhesive panels 20, preferably composed of a pressure sensitive adhesive material 19, which may be applied by coating during the process of manufacturing sheet 12. A central gap 21 in the coating, having a width of about a half inch, preferably extends along one side of fold line 18 to further facilitate the subsequent proper folding of form 10 into postcards. A peripheral gap 22 in the coating preferably extends along two or more edges of sheet 12 to minimize a potential problem of adhesive 19 being squeezed outward from between front sheet 12 and rear sheet 14 during the application of pressure to fuse toner in a laser printer.

Figure 3:
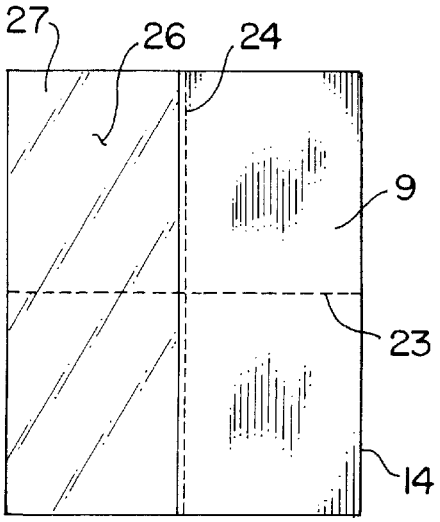
FIG. 3 is a front elevational view of a back sheet in the embodiment of FIG. 1.

FIG. 3 shows a view of the interior side 9 of back sheet 1 4, which is divided into four sections by centered and perpendicular tear lines 23 and 24. A release panel 26 is formed by coating one surface of back sheet 14 with a release material 27, such as a silicone release material. Release panel 26 is a type which can be easily pulled away from the pressure sensitive adhesive 19 used to form adhesive panels 20 (shown in FIG. 2).

Figure 5:
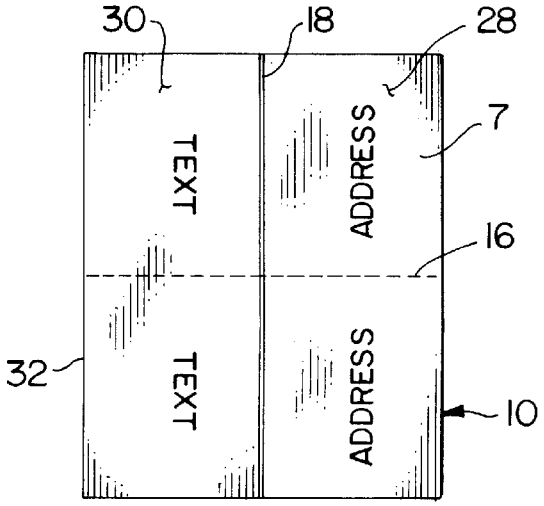
FIG. 5 is a front elevational view of an application of the embodiment of FIG. 1, showing the relative placement of information thereon during a printing step.
Figure 4:
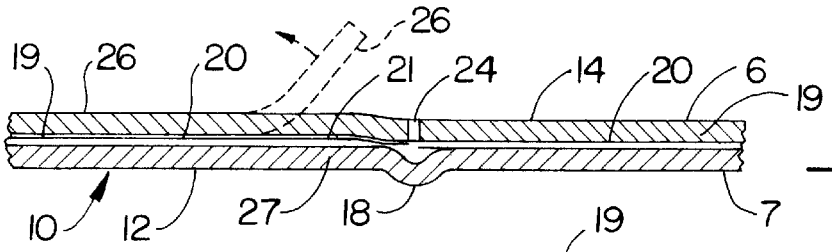
FIG. 4 is a partial transverse cross-sectional view of the embodiment of FIG. 1, taken as indicated by section lines IV—IV in FIG. 1.
Figure 6:
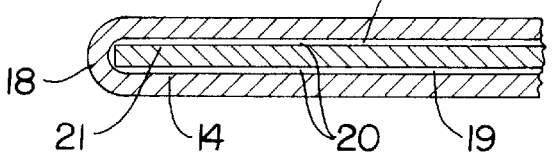
FIG. 6 is a partial transverse cross-sectional view of an application of the embodiment of FIG. 1, following a folding step.

FIG. 4 is a transverse cross-sectional view of form 10, taken across lines IV—IV of FIG. 1, after assembly of form 10 by pressing the interior side 8 of front sheet 12 (shown in FIG. 2) against the interior side 9 of back sheet 14 (shown in FIG. 3), leaving the outward facing side 6 of back sheet 14 and image receiving side 7 of front sheet 12 exposed. While back sheet 14 adheres to both adhesive panels 20 of front sheet 12, the portion of back sheet 14 having release panel 26 is releasably adhered, so that it can be subsequently peeled off and torn away, as seen by the dashed lines. Gap 21 in the adhesive coating 19 overlies a central edge portion of release panel 26. it should be noted that when sheets 12 and 14 are assembled as described in FIGS. 1–4, transverse tear line 23 underlies transverse tear line 16 to allow the subsequent separation of form 10 into two halves. of form 10 is shown in FIGS. 5 and 6, in which two postcards are formed by first printing address and text information on form 10 and thereafter, by dividing form 10 into two postcards by separating it along aligned tear lines 16 and 23, by peeling away release panel 26 and by folding the exposed adhesive 19 covered portion of front sheet 12 over the remaining portion of back sheet 14. FIG. 5 schematically illustrates the appearance of form 10 after the printing step. Each postcard has an address side 28 and a text side 30, with the printed material on each side being preferably oriented, as shown, to be read away from fold line 18.

A printer, controlled by a conventional computer system, is preferably used to print information as shown in FIG. 5, with the computer system under the control of a program designed or modified specifically for this type of application. While many word processing programs and printers can print sideways, or in the "landscape model', all letters still face the same direction. However, most word processing programs in common use today, do not include the capability of printing letters with different orientations, such that some of the printed material is orientated relative to one side and the remaining printed material is orientated from the other side, as shown in FIG. 5. However many other commercially available programs, such as CAD/CAM programs do have this capability and it is a relatively straightforward matter to design a computer program with typefaces having this capability. Such a program could also have the ability to generate other markings required or desired by the U.S. Postal Service, such as the Facing Identification Mark (FIM) patterns, placed to the left of the area to which a stamp may be affixed, for identifying identify certain types of mail, and the POSTNET bar code, placed along the lower edge of the card, which represents the ZIP code of the address.

FIG. 6 shows the configuration into which each postcard is folded after the address information 28 and text information 30 is printed, panel 26 is removed and the adhesive 19 exposed portion of front sheet 12 is folded over and attached to the remaining portion of back sheet 14. More specifically, the two postcards shown in FIG. 5 may be separated by separation along tear lines 16 and 23, either before of after folding. Before folding, the side of back sheet 14 upon which release panel 26 is coated is peeled back from front sheet 10 and discarded. The postcard being formed is then folded along central fold line 18, with the adhesive panel 20 exposed by the removal of release panel 26 being brought into contact with the rear surface of the remaining side of back sheet 14. The postcard thus formed is pressed together to form a permanent assembly on both sides of the pressure sensitive adhesive 19 in panel 20.

In this way, a postcard is formed, having a thickness of three sheets of paper, that is twice the thickness of front sheet 12, together with the thickness of back sheet 14, and the relatively negligible thickness of two layers of adhesive 19. Before the separation and folding processes, the back sheet 14 acts to protect the entire adhesive 19 coated surfaces from contact with other objects. After the folding process, half of the back sheet 14 acts to increase the thickness and stiffness of the postcard.

Figure 7:
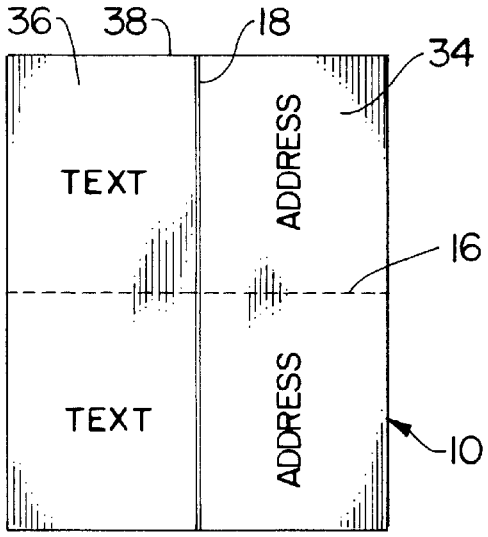
FIG. 7 is a front elevational view of an alternative application of the embodiment of FIG. 1, showing the relative placement of information thereon during a printing step.

FIG. 7 illustrates an alternative technique to print information on a form 10 using commercially available software. In FIG. 7, each postcard has an address side 34 and a text side 36, with the printed material on address side 34 being oriented to be read downward from the adjacent fold line 18, and with the material on text side 36 being oriented to read downward from a short side 38 of form 10. The primary advantage of the printing format shown in FIG. 7 is that it can be produced using a standard word processing program, such as Word Perfect 5.1, with a system having "landscape" printing mode capabilities. A method for obtaining a format with type running in two directions in this way is described, for example, in Using Word Perfect 5.1, Special Edition, Que Corporation, Carmel, Ind., 1989, pp. 1134–1138.

One problem typically associated with the use of a pressure sensitive adhesive is caused by the instantaneous nature of the bonding process with such an adhesive. After two objects are brought together, it is difficult or impossible to move them for improving their alignment. This problem is alleviated by forming fold line 18, extending along the line where the fold is to occur, during the process of manufacturing form 10. This problem is further alleviated by providing central gap 21 between adhesive panels 20, so that the folding process can include the alignment of the two sides of front sheet 12 before contact is made between the exposed adhesive panel 20 and the rear surface of back sheet 14.

While the adhesive used in the various embodiments described herein are typically described as being pressure sensitive, or contact, adhesives, it is understood that other adhesives, such as moisture activated adhesives, could be used instead.

The various embodiments described herein also include a number of tear lines. This term is meant to describe a line along which the material of a sheet is weakened so that it can be easily separated. Tear lines may be formed, for example, by perforating the sheet, so that a line is formed among a plurality of holes, or by die-cutting a series of slots in alignment, so that the sheet material between the slots can be easily broken. When tear lines are superimposed on the front and back sheets, they may be produced after the sheets are assembled. It is also possible to limit the penetration of a die, so that die-cut lines can be cut through only one sheet after assembly.

These embodiments also include a number of fold lines, which provide lines along which folding preferably occurs. Such lines may be produced, for example, by embossing, by creasing the sheet, or by simply printing a line indicating where a manual fold should be made.

U.S. Postal regulations require a minimum thickness of 0.007 inch, with an indication that card stock should not exceed 0.0095 inch when firmly compressed. It is expected that these limits may be increased somewhat as automated mail handling equipment comes into wider use, requiring greater strength and stiffness in individual pieces of mail to prevent double feeds on automatic sorting equipment. In any case, a suitable overall card thickness can be easily achieved by using a typical paper thickness of about 0.003 inch for front sheet 12 and back sheet 14.

The size of form 10, before folding, is preferably a size which may be conveniently run through a standard printer, and the size of the postcards formed by this process is preferably one which is acceptable to postal authorities for mailing at the reduced postal rates available for postcards. For example, form 10 may be 8.4 by 11 inches, thereby forming two 4.2 by 5.5 inch postcards.

Alternatively, a conventional 8.5 by 11 inch sheet of paper with a discardable edge portion may be used to bring the size of the resulting postcards within Postal Service regulations. By using forms 10 having a size as noted above permits a large number of forms 10 to be stacked in a printer feeding tray for sequential feeding through the standard paper feed mechanism of a printer. Thus, the present invention provides the advantage of using special forms with a standard office printer under the control of a computer system, whereby a large number of documents of similar types, having variations in printed text, can be generated in a more or less continuous process, without a necessity for loading individual forms into the printer.

Figure 8:
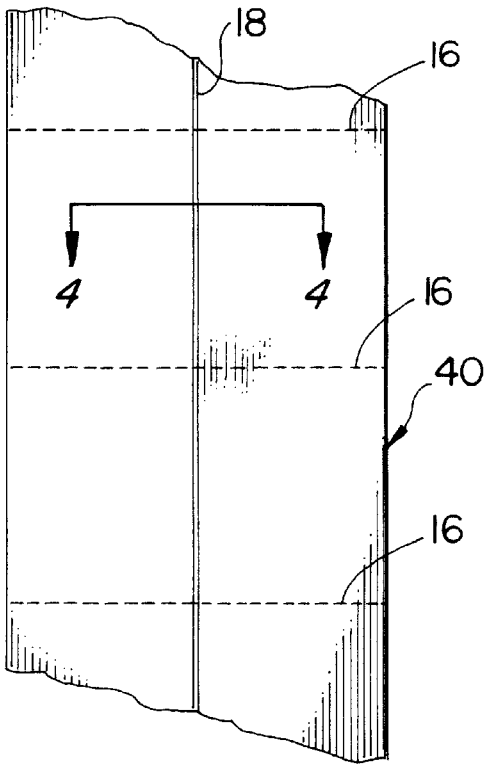
FIG. 8 is a partial front elevational view of a second embodiment of this invention, being configured as a continuous form.

Referring now to FIG. 8, a front elevational view of a second embodiment of the present invention is shown, in which a continuous form 40 is provided for use in a printer having a capability of printing continuous documents. In FIG. 8, features similar to those discussed above with respect to form 10 are referenced with like numerals. A central fold line 18 is provided for use as previously described, with a number of transverse tear lines 16 being included to facilitate the separation of form 40 into many individual postcards after printing. Most other aspects of form 40 are as previously described with respect to form 10, with the transverse cross-section of form 40, taken as indicated by section lines IV—IV, being also shown in FIG. 4. Thus, form 40 includes front and back sheets, with a back sheet including transverse tear lines underlying tear lines 16 and central fold line 18. The rear surface of the front sheet of form 40 includes a pair of adhesive panels 20 extending the length of form 40, and the front surface of the back sheet of form 40 includes a release material 27 at one side of a central tear line 24.

Figure 9:
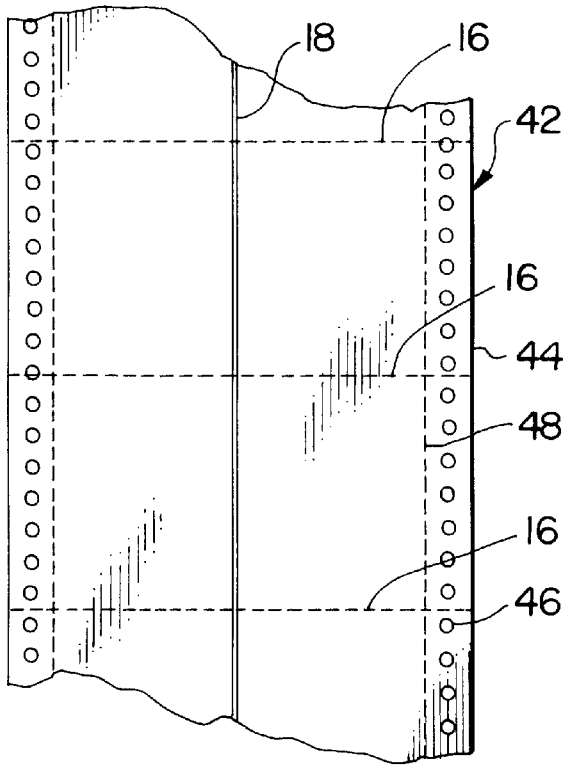
FIG. 9 is a partial front elevational view of an alternative variation of the embodiment of FIG. 8, being configured for use with a pin feed mechanism.

FIG. 9 is a front elevational view of a form 42, which is a variation of form 40 shown in FIG. 8. Form 42 has one or both of the front and back sheets extended to include lateral strips 44 with holes 46 for use by a standard pin feed paper handling mechanism. Tear lines 48 extend between the lateral strips 44 and the adjacent portions of form 42, so that strips 44 can be easily torn away and discarded after the printing process.

Figure 10:
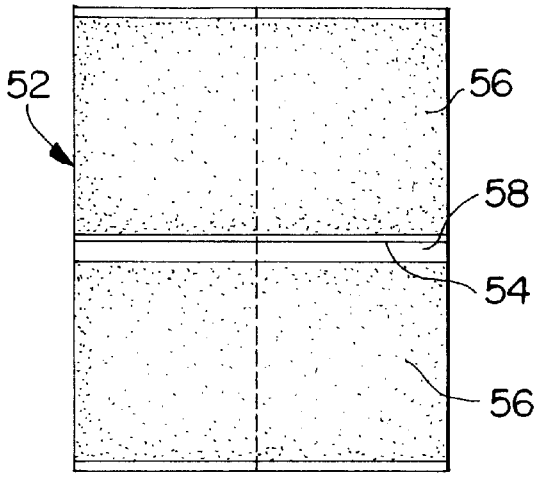
FIG. 10 is a rear elevational view of a front sheet used in a third embodiment of this invention.
Figure 11:
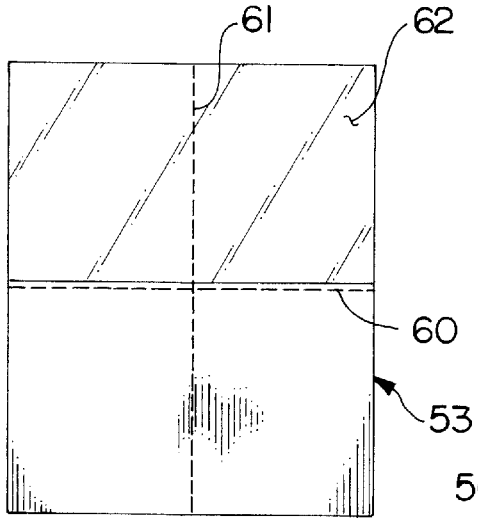
FIG. 11 is a front elevational view of a back sheet used with the front sheet of FIG. 10.
Figure 12:
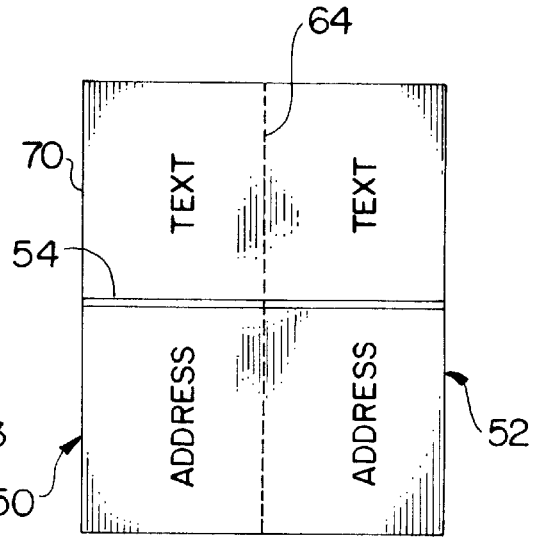
FIG. 12 is a front elevational view of an application of the embodiment of FIG. 10, showing the relative placement of information thereon during a printing step.

FIGS. 10 through 12 show a form 50, which is a third embodiment of the invention. FIG. 10 is a rear elevational view of a front sheet 52 used in the construction of form 50, while FIG. 11 is a front elevational view of a back sheet 53 used therein. FIG. 12 is a front elevational view showing the use of form 50.

Referring first to FIG. 10, the details of construction of form 50 are similar to those of form 10, except that form 50 is configured for folding along a fold line 54 extending transversely across front sheet 52, while form 10 is configured for folding along a fold line 18 extending longitudinally along front sheet 12 (shown in FIG. 1). Thus, the rear surface of front sheet 52 includes a pair of adhesive panels 56 on opposite sides of fold line 54, with a central gap 58, about a half inch in width, extending in one direction from fold line 54 to separate the panels 56.

Referring to FIG. 11, back sheet 53 includes a transverse tear line 60, which underlies fold line 54 of front sheet 52 (shown in FIG. 10) when sheets 52 and 53 are assembled together, and a longitudinal tear line 61. A release coating layer 62 is applied to the front surface of back sheet 53 on one side of transverse tear line 60. The side of back sheet 53 having release coating layer 62 is laminated to the side of front sheet along which coating gap 58 extends.

FIG. 12 shows a postcard application of form 50. Two postcards are printed with address data 64 and text data 66, to be separated along a longitudinal tear line 68 and folded along fold line 54. Text and data information is preferably all oriented to read downward from one of the longer edges 70 of the form. Tear line 61 underlies tear line 64 when sheets 52 and 53 are assembled together to make form 50. One advantage of this configuration arises from the fact that a conventional relationship between the orientation of text and address information occurs when all text and address information is oriented in the same direction during the printing process. This orientation can be easily attained using the standard "landscape" mode of a printer.

FIGS. 13 through 18 show various aspects of a fourth embodiment of the invention, in which a single form 72 provides various elements required for sending certified mail. Form 72 is preferably 8×14 inches, a size which can be easily handled by standard printers. Certain information, generally required by the Postal Service may be pre-printed on form 72, while other information, which may be customized for each mailing, is printed on form 72 by a printer. Form 72 is preferably passed through a printer controlled by a computer system operating under control of a software program developed to place specific information in certain places on the form.

Generally, form 72 includes a front sheet 74 and a back sheet 75, each of which preferably has a thickness of a standard sheet of paper, about 0.003 inch.

Sheets 74 and 75 are held together with an adhesive material 76 layer coated on the rear surface of front sheet 74. In certain locations, described in detail hereafter, a release material 77, such as a silicone compound, is coated on the front surface of back sheet 75, so that certain parts of back sheet 75 can be readily detached from the assembled form 72.

Figure 14:
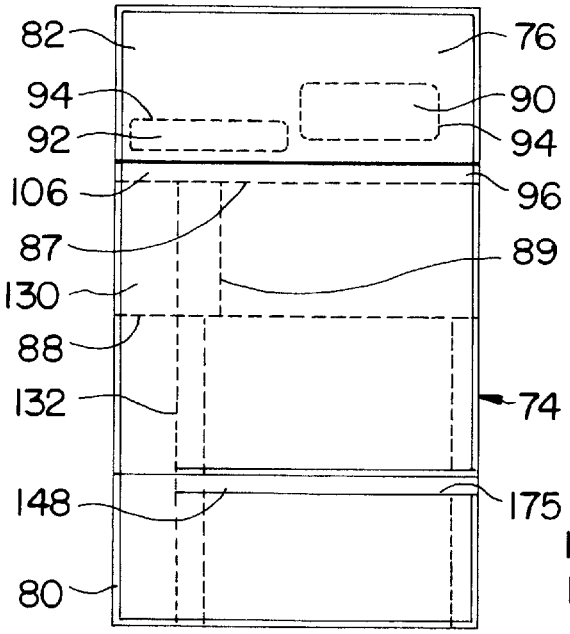
FIG. 14 is a rear elevational view of a front sheet used in the embodiment of FIG. 13.
Figure 15:
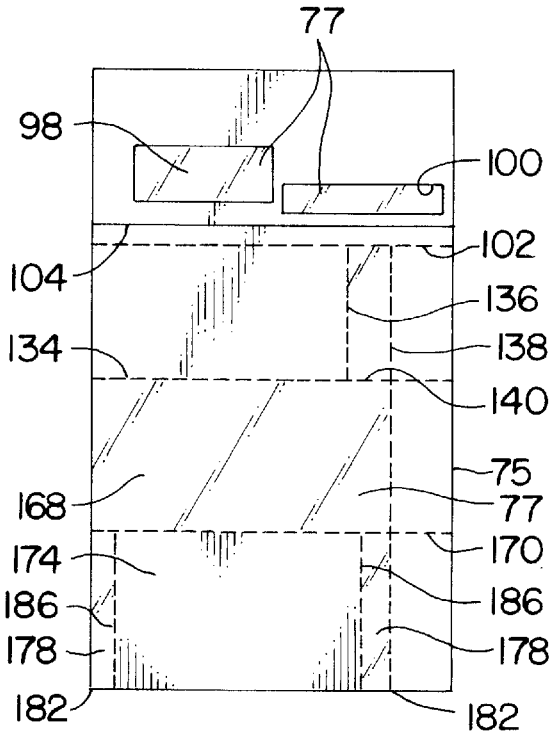
FIG. 15 is a front elevational view of a back sheet used in the embodiment of FIG. 13.
Figure 13:
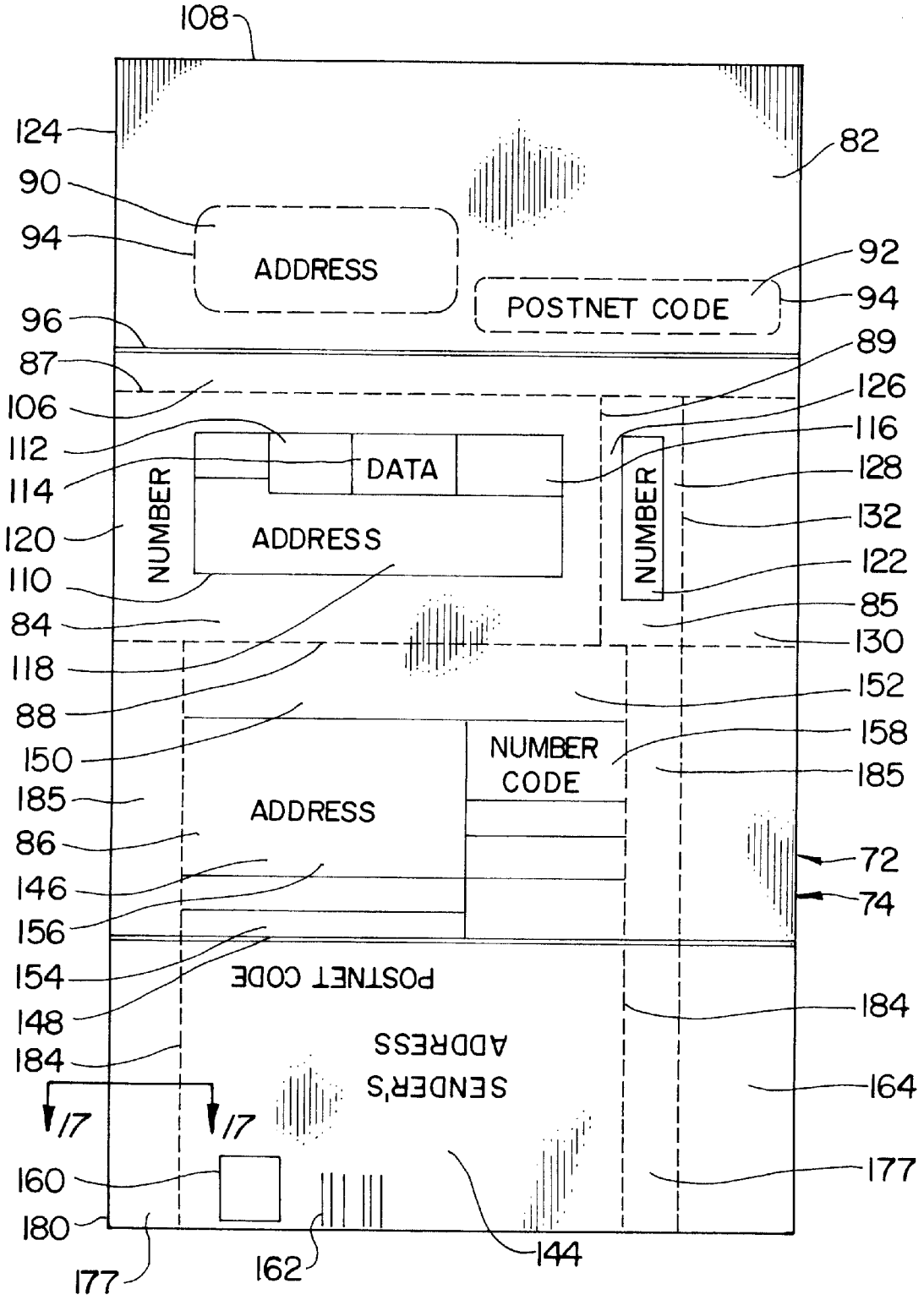
FIG. 13 is a front elevational view of a fourth embodiment of the invention, showing the relative placement of information thereon during a pre-printing step and during a printing step within a non impact printer.

With respect to form 72, FIG. 13 shows the front of form 72, and specifically the front, of facing, side of front sheet 74 and the location of various tear lines and fold lines. FIG. 13 also indicates, in a general manner, both the type of general information which may be pre-printed on form 72, and the type of selective information printed during a pass through a printer. FIG. 14 shows the back of front sheet 74, and more particularly, the pattern of a pressure sensitive adhesive material 76 layer. A margin 80, about 1/16 inch wide, is provided around panel 76, so that adhesive 76 is not squeezed out of the form during passage through the fuser of a laser printer. FIG. 15 shows the front, or facing side back sheet 75, including the pattern of the coated release material, together with various tear lines and fold lines.

Referring specifically to FIG. 13, the front of form 72 includes an address section 82, a sender's receipt section 84, a certified mail label 85, and a return receipt 86. These sections are mutually separable by means of transverse tear lines 87 and 88, and by a tear line 89 extending between sender's receipt section 84 and certified mail label 85. While address section 82 is included to provide assistance in preparing an envelope for mailing, sender's receipt section 84, certified mail label 85, and return receipt 86 are included to replace specialized materials which are otherwise available from the U.S. Postal Service, in order that these materials can be readily filled but through the use of a printer. Address section 82 includes a pair of removable label areas 90 and 92, which are defined as separable from the remainder of section 82 by means of die-cut tear lines 94.

When form 72 is passed through a printer, the address to which the certified letter is to be sent is printed on label area 90, and the POSTNET code, which is a bar code representing the ZIP code of the address, is printed on label area 92. As seen in FIG. 14, an adhesive material 76 layer, coated on the rear surface of front sheet 74, holds the portion of address section 82 lying above a fold line 96 in place on the corresponding portion of back sheet 75, seen in FIG. 15.

Referring to FIG. 15, on the inner surface of back sheet 75, release materials 77, such as silicone release coatings, are placed over panels 98 and 100, which underlie label areas 90 and 92, respectively. Thus, the label areas 90 and 92 can be easily removed from form 72 by tearing along die-cut tear lines 94 and by peeling label areas 90 and 92 away from the corresponding coated portions of back sheet 75. Back sheet 75 also includes a transverse tear line 102 underlying transverse tear line 87 of front sheet 74, and a fold line 104 underlying fold line 96 of front sheet 74.

After the printing has occurred, address section 82 is separated from sender's receipt section 84 by tearing along superimposed transverse tear lines 87 and 102. Address section 82 is designed to fit into a standard window envelope, that is, an envelope with a transparent window in a standard location, through which a printed address is visible through the window. To permit address section to fit into a standard window envelope, the lower tab 106 formed between aligned tear lines 87 and 102 and aligned fold lines 96 and 104 is folded upward behind the remaining portion of section 82, along superimposed fold lines 96 and 104.

In a preferred version, the length of address section 82, is sufficient to provide a standard overall length of 14 inches for form 74, with lower tab 106 having a width sufficient that section 82, when folded as described, can fit into a standard number nine or number ten window envelope.

While standard window envelopes do not presently have provisions for viewing a POSTNET bar code through a window, it is felt that, as the preparation of this coded information by the originator of mail, instead of by the U.S. Postal Service, becomes more widespread, such window envelopes will become available. In any event, a standard spatial relationship is maintained between the address printed on label area 90 and the POSTNET code printed on label area 92.

Where window envelopes are not used, or window envelopes having only an address window are used, one or both of the label areas 90 and 92 may be easily detached for application to the outside of an envelope. Because of the presence of release materials 77 in panels 98 and 100, the adhesive material 76 coated on the rear surfaces of label areas 90 and 92 is not damaged when one of the labels is peeled away from back sheet 75 adhesive material 76 layer can then be reused to attach the label areas to another surface, such as an envelope or package to be sent by certified mail.

Sender's receipt section 84 is preferably designed to provide the functions of Postal Service Form 3800, being divided into a number of blocks by a pattern of pre-printed lines 110. Front sheet 74 is preferably white, with pre-printed information on sender's receipt section 84 being printed in a green color used by the U.S. Postal Service to signify such documents associated with certified mail. Block 112 has a pre-printed number of postal fees associated certified mail. These fees may be calculated and a total provided by the program controlling the operation of the printer, to be printed at adjacent locations in block 114. Block 116 provides a location where a postmark stamp can be placed by a postal official. The address to which the certified mail is sent is printed by the printer in block 118. Form 72 is also provided with a conventional certified mail identifying number, which is printed both at the left margin 120 of sender's receipt section 84 and at a central area 122 of certified mail label 85. In accordance with postal regulations, this number is a nine digit number preceded by the letter "P," with spaces between the letter and the number and between three groups of three digits each. The identifying number is printed in OCR-A font for optical character recognition read downward from left edge 124 form 72.

Certified mail label 85 is preferably pre-printed with a green border around central area 122, using the same green ink used to pre-print information on sender's receipt section 84. While not shown, the words "CERTIFIED" and "MAIL" appear in reverse printing in locations 126 and 128 within the border, to be read downward from left edge 124 of form 72. Reverse printing may occur by not preprinting the green ink so as to form the words "CERTIFIED" and "MAIL". Thus, the words "CERTIFIED" and "MAIL" appear white, as front sheet 74, within the solid green border around area 122.

A discardable section 130, adjacent to certified mail label 85, and separable therefrom by means of a tear line 132, is discarded during the use of form 72. The additional material 130, as well as the additional material in discardable section 164 (discussed hereafter), is included within form 72, so that the overall dimensions of form 72 conform to the standard paper size eight and one half by fourteen inches, while maintaining the various sections within form 72 to the standard dimensions required therefore.

Referring to FIG. 15, back sheet 125 includes tear lines 134, 136, and 138 underlying tear lines 88, 89, and 132 of front sheet 74, so that sender's receipt section 84, certified mail label 85, and discardable sections 130 and 164 can be easily separated. A release panel 140, coated with release material 77, is provided in on the interior surface of the portion of back sheet 125 underlying certified mail label 85, so that the portion of front sheet 74 forming label 85 can be easily removed from back sheet 75, exposing an intact adhesive 76 covered surface for attaching label 85 to the envelope being mailed, next to the return address.

Referring again to FIG. 13, return receipt 86 is preferably configured to provide the functions of Postal Service Form 3811, being divided into a lower section 144 and an upper section 146 by a fold line 148. The postcard is formed after being printed, according to the folding method generally described in reference to FIGS. 1 through 7. Return receipt 86 is preferably pre-printed to form a background color with a half tone screen, using the same green ink used to preprint information on sender's receipt section 84 and certified mail label 85. The half tone screen permits simulation of the light green card stock used by the U.S. Postal Service to make Form 3811 easily recognizable. Other pre-printed markings on return receipt 86 are preferably black. On the reverse side of Form 3811, upper section 146 includes a number of pre-printed blocks required on return receipt 86, such as block 150, which includes pre-printed instructions for the sender, block 152, which provides spaces to indicate whether additional services are desired, and block 154, which provides a space for the signature of the addressee.

In the printing process, the address of the certified mail recipient, which is placed in label area 90, is also placed in block 156 of lower section 146. In addition, the identifying number, which is placed in left margin 120 of sender's receipt section 84 and in central area 122 of certified mail label 85, is also printed in block 158, oriented to be readable when upper form 72 is held upward. Again, this number is printed, with a preceding letter "P," in an OCR-A font. In the same printing process, a bar code representing the identifying number may be printed below the number.

Return receipt 86 is prepared to be sent with the certified mail, for return to the sender, by the Postal Service, in verification of receipt of the mail. Therefore, lower section 144 is pre-printed for this purpose, with a U.S. MAIL emblem 160, as required to send a document through the mail on official business of the Postal Service. An FIM code 162 for this type of service is also pre-printed. During the pass through the printer, the sender's address and the POSTNET code representing the ZIP code within the sender's address are printed in appropriate locations on lower section 144. All printing on lower section 144 is done with an inverted orientation, so that the information will be read downward towards edge 108. Return receipt 86 is separable from discardable section 164 by means of tear line 132 extending through front section 74 so that it is the proper size.

Referring again to FIG. 15, a tear line 138 underlies tear line 132, and the front surface of a section 168 of back sheet 75, underlying upper section 146, is coated with release material 77. Section 168 is separable from the remainder of back sheet 75 by means of a transverse tear line 170 which underlies fold line 148 of front sheet 74. Before return receipt 86 is folded into postcard form, section 164 (shown in FIG. 13) is detached and discarded. Next, detachable backing section 168 is detached and discarded, tearing along tear line 170 to reveal an intact adhesive material 76 layer of first sheet 74, previously adjacent to the coated surface of panel 168. Then, the remaining portion of return receipt 86 is folded along fold line 148, with adhesive material 76 layer forming a tight-bond with the rear surface of a panel 174 of back sheet 75. In order to facilitate the alignment of adhesive 76 with the rear surface of panel 174, a gap 175, about a half inch in width, is provided in the adhesive material 76, extending upward from fold line 148. The structure of various elements, before and after the folding procedure, is similar to that which has been previously described and shown in FIGS. 4 and 6, respectively.

Figure 16:
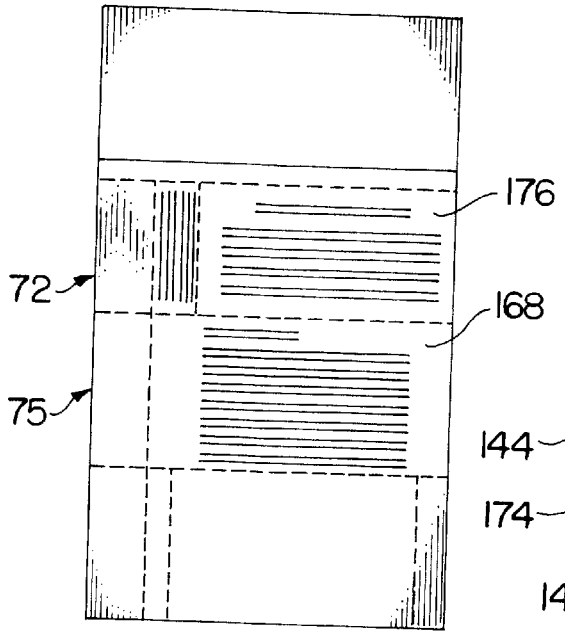
FIG. 16 is a rear elevational view of the embodiment of FIG. 13, showing the relative placement of pre-printed information thereon.

As shown in FIG. 16, various types of information, such as instructions on the use of form 72, may be printed on the outward facing surface of back sheet 75, which is the rear surface of form 72 after sheets 74 and 75 are assembled. For example, even through detachable backing section 168 is removed and discarded during the process of forming return receipt 86 into a postcard, its back surface can be used for providing pre-printed information regarding how the various parts of form 72 should be separated, folded, and used. Other sections of back sheet 75 are not discarded; remaining instead with corresponding sections of front sheet 74. The rear surfaces of such sections are particularly useful for providing pre-printed information relative to the use of these particular sections. For example the back sheet portion 176 of sender's receipt 84 can be used in this way.

Referring again to FIG. 13, as previously mentioned, return receipt 86 is prepared to be sent with the certified mail. To this end, a special provision is made for the attachment of return receipt 86 to the certified mail being sent, through the use of tabs 177 extending at each end of lower section 144. As shown in FIG. 15, release material 182 is applied over tabs 178 as a part of back sheet 75.

Figure 17:
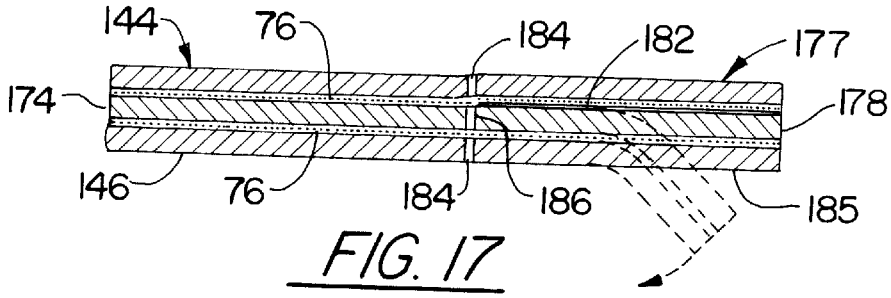
FIG. 17 is a transverse cross-sectional view of an attachment tab portion of the embodiment of FIG. 13, shown after a portion of the embodiment is folded into a postcard configuration as indicated by section lines XVII—XVII in FIG. 13.

Attachment of return receipt 68 to a mailing envelope or package will now be explained, with particular reference being made to FIGS. 17 and 18, which are transverse cross-sectional views of one of the tabs 177, together with adjacent portions of front section 144 and reverse section 146. FIG. 17 is taken as indicated—by section line XVII—XVII in on lower section 144 of FIG. 13 after return receipt 86 has been folded into a postcard configuration along fold line 148.

Referring to FIG. 17, when return receipt 86 is folded into a postcard configuration, lower section 144 and rear section 146 of front sheet 74 become outer layers in an assembly having three layers, including a central layer formed by backing panel 174, with single adhesive material 76 layers between each of the paper layers. This portion of FIG. 17 is similar to FIG. 6. However, underlying tab 177, which extends outward from lower section 144, is release material layer 182 for limiting the adhesive attraction between tab 177 and tab 178.

Figure 18:
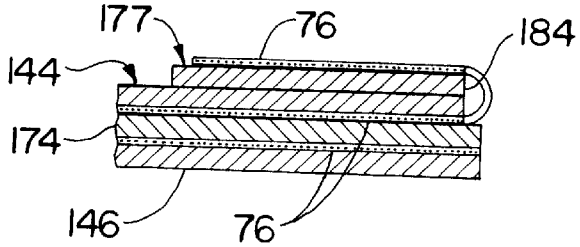
FIG. 18 is a transverse cross-sectional view of the attachment tab portion of the embodiment of FIG. 13, shown after the tab is folded to expose an adhesive material layer for attachment to another object.

Referring to FIG. 18, the presence of release material 182 makes it easy to peel tab 177 upward, about a tear line 184 extending through front sheet 74 between lower section 144 and after both tabs 177 are folded upward in this way, adhesive 76 covered surfaces are upwardly exposed for use in the attachment of return receipt 86 to an article being sent by certified mail. At this point, tabs 178 and an underlying tabs 185, which extend outward from reverse section 146, may be detached, by tearing along tear lines 186 between tabs 178 and section 174, and the portions of tear lines 184 between tabs 185 and upper section 146. When the article is subsequently successfully delivered, the postal worker separates return receipt 86 from the article, tearing along tear lines 184 to separate tabs 177, which remain with the article, from the remainder of return receipt 86. The postal worker then sends return receipt 86, through the mail, back to the sender, as indicated by the sender's address on lower section 144.

The method described above for attaching return receipt 86 to the article being mailed has an advantage over the method described in U.S. Pat. No. 4,683,792 to Walz. With the method described above, the adhesive surfaces used for fastening to the article are moved inward from the outer edges of the card forming return receipt 86; with the method of Walz, the adhesive strips extend outward from the card. This reduction in the length of the return receipt, as it is attached to the article being mailed, provides more flexibility for locating the return receipt of the present invention on different types of articles being mailed.

Variations of the fourth embodiment of this invention, which has been discussed above in reference to FIGS. 12 through 18, will now be discussed in reference to FIGS. 19 through 24, with previously discussed common features being accorded like reference numerals. These variations exhibit differences in the resulting configuration of the adhesive tabs used to attach the return receipt portion of the form to the certified mail being sent.

Figure 19:
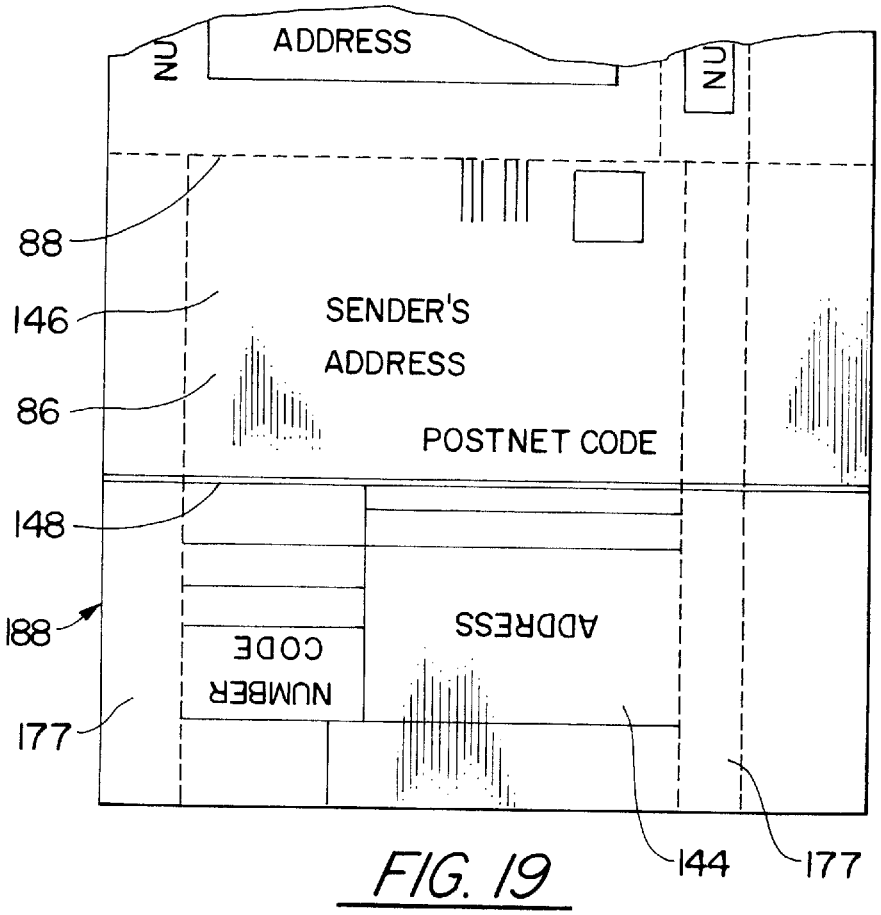
FIG. 19 is a partial front elevational view of a first variation of the embodiment of FIG. 13, showing the relative placement of information thereon during the pre-printing step and during the printing step with a printer.

Referring first to FIG. 19, the pre-printed information on a return receipt portion 86, of a first alternative form 188, are inverted, or rotated together 180 degrees, from the similar information shown in FIG. 13 on form 74. Furthermore, the information printed in this area by the printer is similarly inverted from the locations shown in FIG. 13. Thus, on form 188, the senders address 190, printed by the printer, and the U.S. MAIL emblem 170, which is part of the pre-printed information, are located on upper section 146. Also, on form 188, the preprinted information, and the information printed by the printer, for the reverse portion of the return receipt card, are printed on lower section 144. The pre-printed and printed information above tear line 88 remains as previously discussed and shown in FIG. 13.

After the appropriate information is printed, form 188 is separated into its various elements as discussed above with respect to FIGS. 12 through 16, and folded into the configuration shown in FIG. 17. However, it is still necessary to attach the return receipt portion of the form to the certified mail being sent with the sender's address portion facing inward, toward the certified mail. Thus, it is now necessary to attach form 188 so that section 146 faces inward. This is accomplished by removing tabs 185 and 178, shown in FIG. 17, to expose the layer of adhesive material 76 on tabs 177. The release material 182 on the front surface of backing layer 75 (also shown in FIG. 15) allows the separation of tabs 178 from the adhesive material 76 layer on tabs 178.

Figure 20:
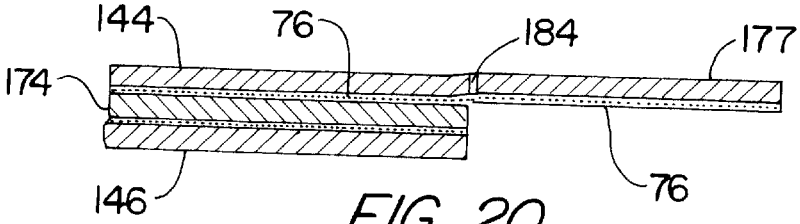
FIG. 20 is a transverse cross-sectional view of the attachment tab portion of the version of FIG. 19, shown after tabs are removed to expose an adhesive material layer for attachment to another object.

Referring to FIG. 20, after the removal of tabs 185 and 178, the outer surface of section 146 and the adhesive material 76 layer on tabs 177 both face in the same direction, in which the form 188 is subsequently applied for attachment to the mail being sent. The difference between the previously explained version, in which the tabs were folded, as shown in FIG. 18, and this version, in which the tabs are left extended, as shown in FIG. 20, may be considered to lie in the fact that, in the previously explained version of FIG. 18, the section of the postcard to be placed against the mail to be sent is attached to the back sheet 75 along a surface without a release material layer, while, in this version of FIG. 20, the section to be placed against the mail to be sent is attached to back sheet 75 along a surface with a release material layer. This difference reverses the way the printed information lies with respect to the back sheet section removed prior to folding, and thereafter to the location of release material layers 182 on back sheet 75. When the certified mail is delivered, the central portion of form 188 is removed for return by tearing along tear lines 184. The method of FIG. 20 has the disadvantage, compared to the method of FIG. 18, of lengthening the document to be attached to the certified mail to be sent, the elimination of a folding step simplifies the use of form 188, while providing somewhat greater strength to hold the attachment tabs to the rest of the form during the mailing procedure.

Figure 24:
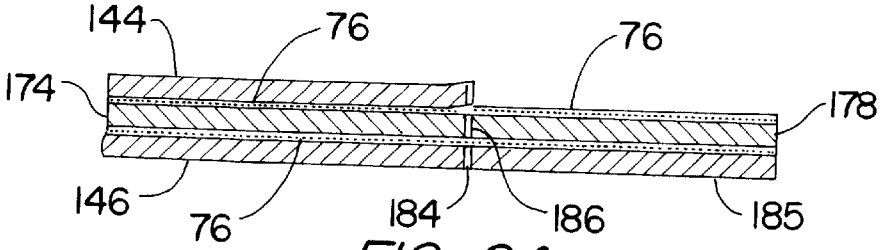
FIG. 24 is a transverse cross-sectional view of the attachment tab portion of FIG. 21, shown after tabs are removed to expose an adhesive material layer for attachment to another object.
Figure 22:
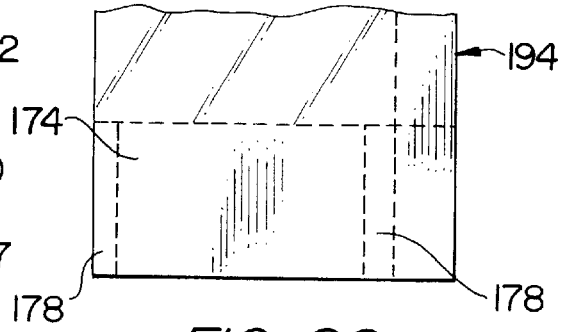
FIG. 22 is a front elevational view of a back sheet used in the variation of FIG. 21.
Figure 23:
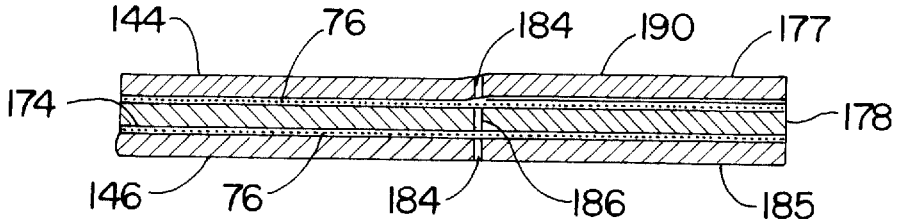
FIG. 23 is a transverse cross-sectional view of an attachment tab portion of the variation of FIG. 21, shown after a portion of the embodiment is folded into a postcard configuration as indicated by section lines XVII—XVII in FIG. 13.

A second alternative version for providing attachment tabs will now be discussed, with particular reference being made to FIGS. 21 through 24. Specifically, FIG. 21 shows a partial rear elevational view of the front sheet of this version, FIG. 22 shows a front elevational view of the back sheet of this version, FIG. 23 shows a transverse cross-sectional view of an attachment tab portion of this version after folding into a postcard configuration, and FIG. 24 shows a similar transverse cross-sectional view after certain tabs are removed to expose the adhesive material 76 layer for attachment.

Figure 21:
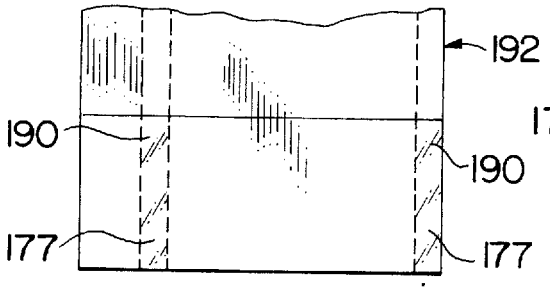
FIG. 21 is a rear elevational view of a front sheet of a second variation of the embodiment of FIG. 13, shown after the application of a release material coating, but before the application of an adhesive material layer.

Referring first to FIG. 21, in the manufacture of the second alternative version, a release material coating 190 is applied to the interior surface of a front sheet 192 in the areas of tabs 177. After the application of release material coating 190, an adhesive material coating, such as coating 76 seen in FIG. 14, is applied to the interior surface of front sheet 192 as previously described and shown in FIG. 14. The adhesive coating is thus applied directly over the release material 190, resulting in a bond which can be subsequently torn apart with relative ease. Referring to FIG. 22, the back sheet 194 of the second alternative version is as previously described and shown in FIG. 15, except that a release material coating is not applied to the front surfaces of tabs 178. The form of this version is otherwise as previously described in reference to FIGS. 13 through 17. Referring to FIG. 23, after the printing step, the form of the second alternative version is folded to provide an attachment tab configuration having a section 144, which is to be placed against the mail being sent, from which a tab 177 extends at each end, with each such tab 177 being separated from the adhesive material 76 layer by a release material coating 190, so that each tab 177 can be easily removed. Referring to FIG. 24, after the tabs 177 (shown in FIG. 22) are removed and discarded, a double sheet thickness of tabs 178 and 185 remains, presenting an adhesive material 76 layer on an outer surface of tab 178 for attachment to the mail being sent.

Thus, while the second alternative version has the disadvantage of extending tabs, when compared to the version described in FIGS. 12 through 18, and of requiring the additional process of coating a material release layer 190 on the rear surface of the front sheet, an advantage is gained of providing a stronger attachment to the mail being sent, since the attachment tabs 177 have double sheet thicknesses, rather than single sheet thicknesses.

In a further embodiment, preferably used for priority mailing procedures, the subject invention comprises a mailing form assembly which provides a mailing label and dual sided or duplex confirmation form on which postal indicia or other information can be printed by a non-impact printer in a single pass through said printer. The assembly comprises a front sheet having a front or outer face and a back or inner face, wherein said inner face has disposed thereon adhesive or adhesive release material in a particular pattern for forming an operational assembly.

The back sheet comprises a front face which faces and can be adhered to the front sheet and a back or outer face. Adhesive or adhesive release material is disposed on the front face of the back sheet in a patterned configuration, i.e., "patterned adhesive" or "patterned release" can be disposed on the front face of the back sheet. The front and back sheets are placed together to form the subject assembly, wherein the front or outer face of the front sheet provides a printable surface for printing information or indicia, and the back sheet forms, in part, a removable adhesive protective layer. Although the subject assembly can be described as having a front sheet and back sheet coated with either adhesive or adhesive-release material, an alternative way to describe the subject invention is as a laminate having a plurality of layers which include two outer layers of paper or other substrate with separate layers of adhesive or adhesive-release material patternly disposed therebetween.

Figure 25:
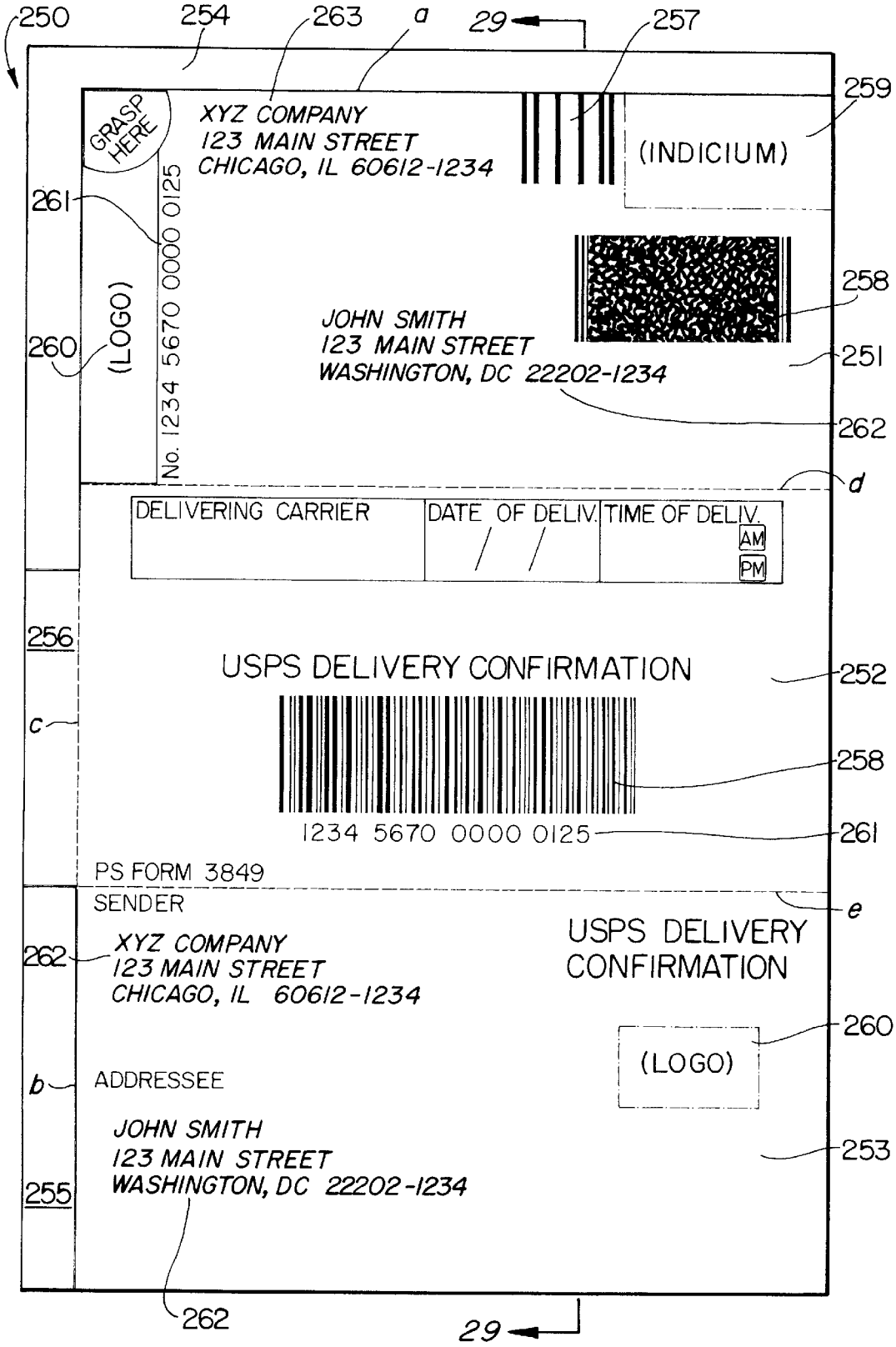
FIG. 25 is a plan view of a front face of a first variation of an embodiment of the assembly according to the subject invention, illustrating a die-cut and perforated tear or fold line pattern, and peel-away border.

A front face of a preferred assembly 250 is shown in FIG. 25. The assembly 250 comprises a plurality of sections, including a top mailing label section 251, a middle section 252 forming a front face of a confirmation form, and a bottom section 253 forming a back face of the confirmation form. The assembly is die-cut or through at least one layer of the assembly to form peel or tear lines or perforated through all layers of the assembly to form fold lines, and separation means for separating one section or area of the form from another. The embodiment shown in FIG. 25 includes a die-cut a which separates the mailing label section 251 from a peel-away border 254 proximate to at least one edge of mailing label section 251. Die-cut b along one edge of confirmation form section 253 forms a peel-away border 255 along one edge of the confirmation form section 253.

Peel-away border 254, in the embodiment shown in FIG. 25, extends along the entire top edge of mailing label section 251 and along a side edge of mailing label section 251, and continuing along a portion of the side edge of the middle confirmation form section 252. The remainder of side edge of the middle confirmation form section 252 comprises a separable border 256 which is divided from middle confirmation form section 252 by a tear-away perforation c. Tear-away perforation d is provided between mailing label section 251 and middle confirmation form section 252 to provide a separation means for separating middle confirmation form section 252 from mailing label section 251 at the time of delivery of the mailing piece. Perforation line e disposed between confirmation form section 252 and confirmation form section 253 is provided as a fold line to facilitate folding over confirmation form sections 252 and 253 to face one another to form a duplex document. Perforation lines d and e preferably are parallel and extend perpendicularly from the tear-away perforation c to the opposite edge of said assembly 250.

Peel-away border 254 provides a means for printing indicia, e.g., a FIM mark, 257 less than one-quarter inch from, e.g., flush with, the top edge of top section 251 of the form. Non-impact printers are not currently capable of printing indicia less then ¼ inch from an edge of a sheet or page; therefore, the tear-away border or margin is preferably at least ¼ inch wide. Indicia such as the two dimensional code 258, postage indication area 259, identification number 261, and addressee and sender addresses 262, 253, respectively, can be laser printed on the top mailing label section at the time of finalizing the form.

Figures 26, 27, 28:
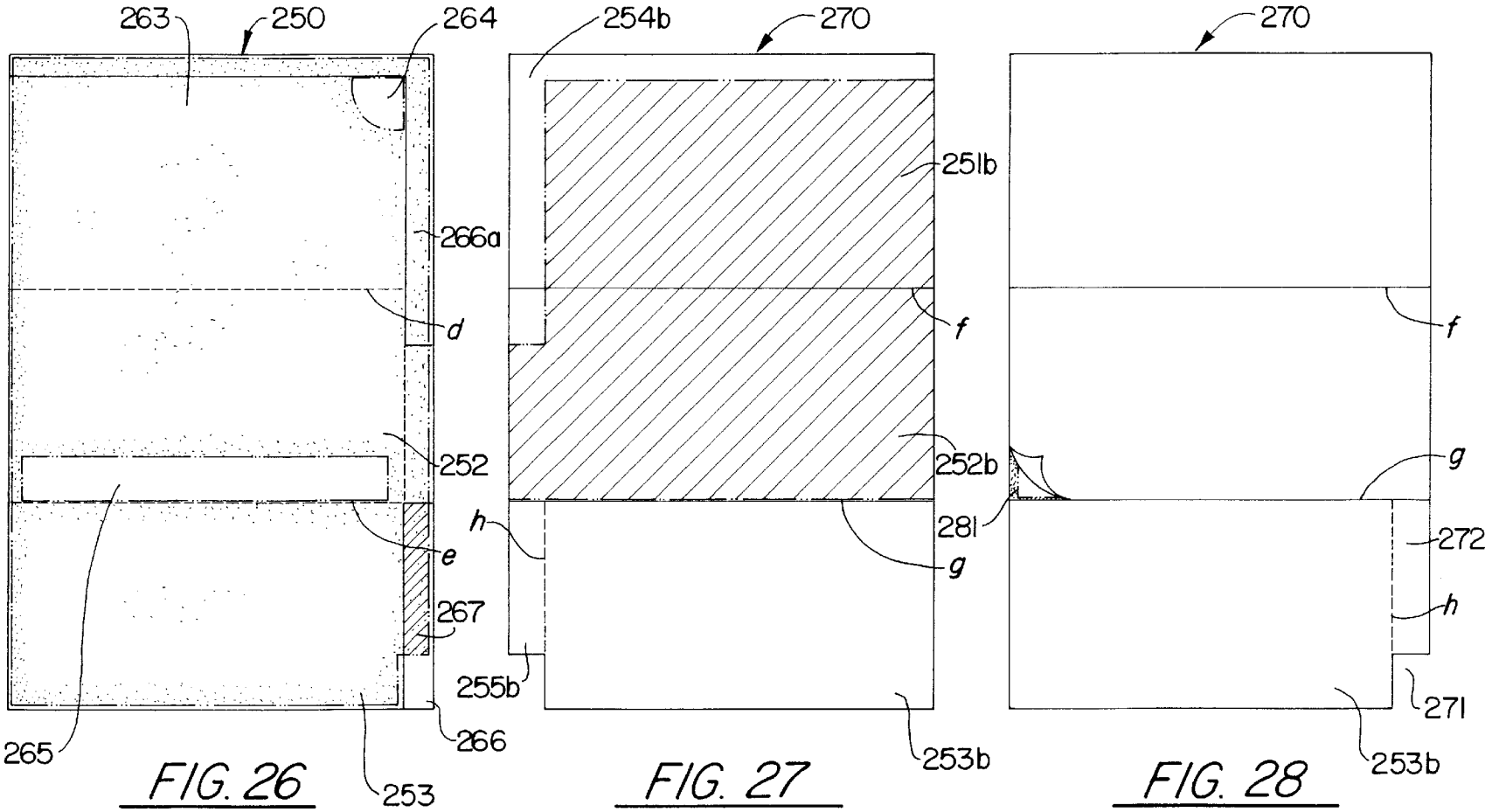
FIG. 26 is a plan view of a back face of a top sheet of the embodiment shown in FIG. 25, illustrating a patterned placement of adhesive.
FIG. 27 is a plan view of a front face of the back sheet of the embodiment of FIG. 25, illustrating a patterned placement of adhesive release material.
FIG. 28 is a plan view of a back face of the back sheet of the embodiment of FIG. 25.

FIG. 26 shows a back or inner face of the front sheet 250 illustrating the areas on which adhesive 263 can be disposed on said inner face. Preferably, a thumb grasp area 264 is adhesive-free to facilitate peel back of a backing sheet. In addition, area 265 is adhesive-free in order to facilitate folding of the confirmation form sections to form a duplex confirmation form. Adhesive-free area 266 is adhesive-free to avoid exposure of adhesive over notched area 271. Adhesive-free gap 265 is provided in order to facilitate squaring of confirmation form sections 252 and 253 along fold line c before adhesion occurs. Specifically, gap 265 facilities forming a tack-free area along fold line c without permanently adhering the back face of bottom confirmation form section 253 to the back face of middle confirmation form section 252. The adhesive is disposed such that an approximately 1/16–⅛ inch margin remains around any edge of the sheet 250. This margin precludes oozing or bleeding of hot-melt adhesive when heated during passage through the fixing stage of a non-impact printer, for example, laser printer.

In addition, FIG. 26 shows adhesive-free area 266 which matches to adhesive area 266*a* when the bottom conformation form section is folded over onto the middle confirmation form section at fold line c. Further, release area 267 is disposed with adhesive-release material on sheet 250 which forms a removable strip 255 (shown as removal strip 255 in FIG. 25).

FIG. 27 shows a front or inner face of a back sheet 270 of the subject assembly. Specifically, adhesive release material is disposed substantially on the entire area corresponding to the top mailing form section 251*b* and the middle confirmation form section 252*b*. An area free of adhesive release material is left on the bottom confirmation form section 253*b*, peel-away border 254*b*, and bottom confirmation form tab 255*b*. Die-cut lines f and g are provided across the entire width of the back sheet of apparatus 270 such that when the back sheet 270 is matched to front sheet 250, the top mailing label section 251*b* and the middle confirmation form section 252*b* are removable from the corresponding mailing label section 251 and middle confirmation form section 252 of the front sheet 250. In addition, a notched area 271 is provided on the back sheet 270 to correspond to adhesive-free area 266 of front sheet 250.

FIG. 28 shows the back face of back sheet 270 of the subject apparatus having die-cut lines f and g corresponding to die-cut lines f and g in FIG. 27. Instructional information 281, for example, a graphical depiction of a removable back sheet, is shown. Notched area 271, corresponding to notched area 271 in FIG. 27 is also shown. Perforation line h in FIG. 27 provides a tear-away strip 272 separable from bottom confirmation form section 253*b*.

Figure 29:
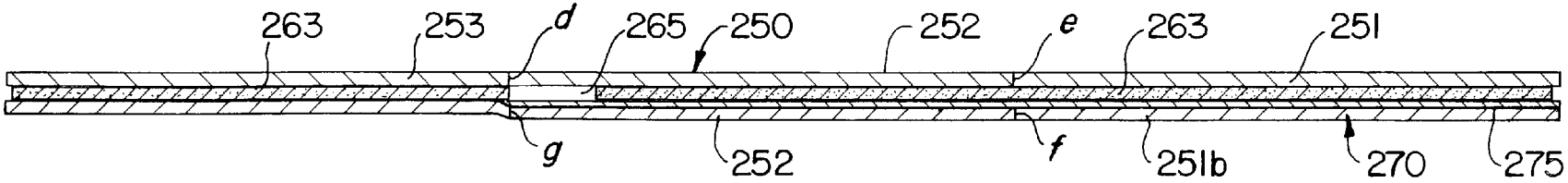
FIG. 29 is a side view of the embodiment of FIG. 25, shown in cross-section along line 3—3.

FIG. 29 is a side view (not to scale) illustrating the various layers of materials comprising the subject assembly. The cross-sectional side view of FIG. 29 is shown as viewed along line 3—3 of FIG. 25. Back sheet 270 having die-cuts f and g can have a layer of adhesive release material 275 disposed substantially over the entire surface area between the top mailing label section 251*b* and middle confirmation form section 252*b*. A continuous top sheet is shown having perforation lines d and e transverse to its thickness. Adhesive material 263 is shown layered between the top sheet 250 and back sheet 270, covering substantially the entire area of top mailing form section 251 and bottom confirmation form section 253. Adhesive 263 covers the entire back face of confirmation section form 252 except for the gap area 265, proximate to perforation fold line e.

Figure 30:
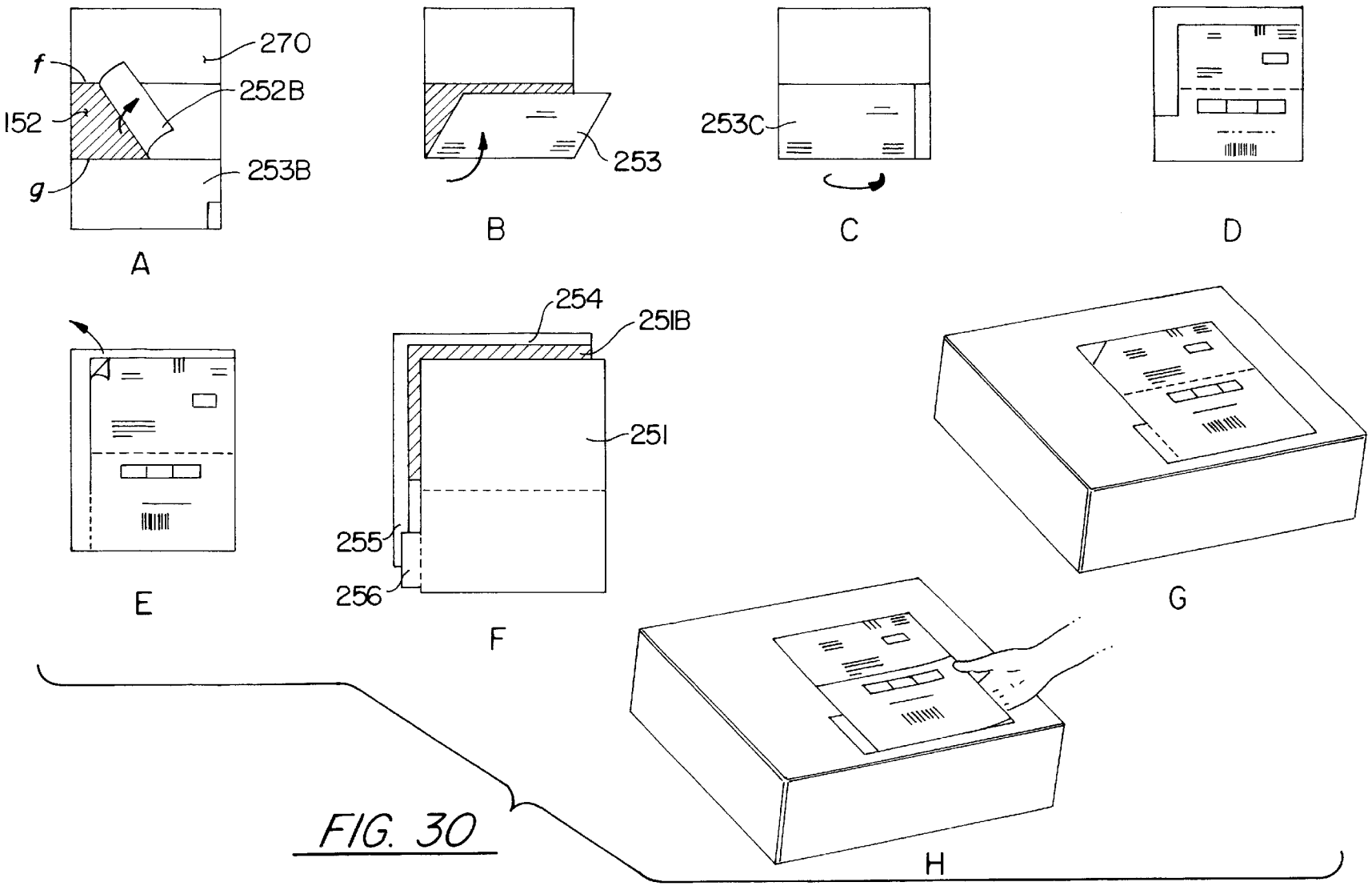
FIG. 30 is a step-wise illustration of use for the embodiment of FIG. 25 on a mail piece.

The subject mailing form assembly can advantageously be used as a mailing address label and delivery confirmation form on which mailing indicia can be printed by a non-impact printer on a single face of said apparatus in a single pass through a simplex printer. Once the variable information is printed on the apparatus, the mailing form apparatus can be applied to a mailing piece, and used as shown in FIG. 30. Specifically, the middle confirmation form section 252B of the back sheet 270 is removed along die-cut peel-lines f and g to expose adhesive on the inner face of the middle confirmation form section 252 of front sheet 250 (step A). Bottom confirmation form section 253*b* and 253 are folded over and adhered to the exposed adhesive to form a duplex confirmation form 253C (step c and d).

As can be seen, this "duplex" formation is actually a plurality of layers or laminate, including middle and bottom sections of the front sheet and the bottom section of the back sheet. The peel-away border 254, and top mailing form section 251B of the back sheet and the removable backing 255 to tab 256 are peeled back (step E) and removed (step F) from top mailing form section 251 as a single piece. The removal of the top mailing form section of the back sheet from 251B exposes adhesive on the inner face of top mailing form section 251 of the top sheet and confirmation tab 255. This adhesive backed top mailing form section 251 of the front face of the top sheet 250 can then be applied to the mailing piece as shown (step G). Upon delivery, the confirmation form 253C can be separated from the confirmation form tab 256 along perforation c and from the top mailing form section 251 along perforation d (step H) and retained in the postal records.

Figure 31:
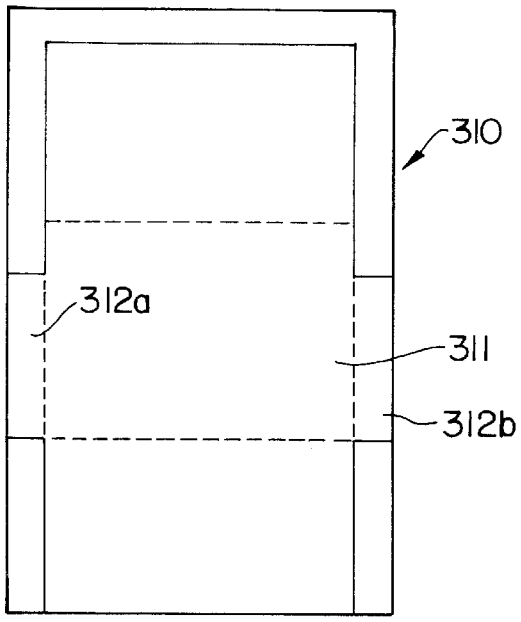
FIG. 31 is a plan view of a first variation of the embodiment of FIG. 25, showing tear-away margins on both sides of the middle section of the assembly which provide for adhering both sides of the confirmation card to a mail piece.
Figure 32:
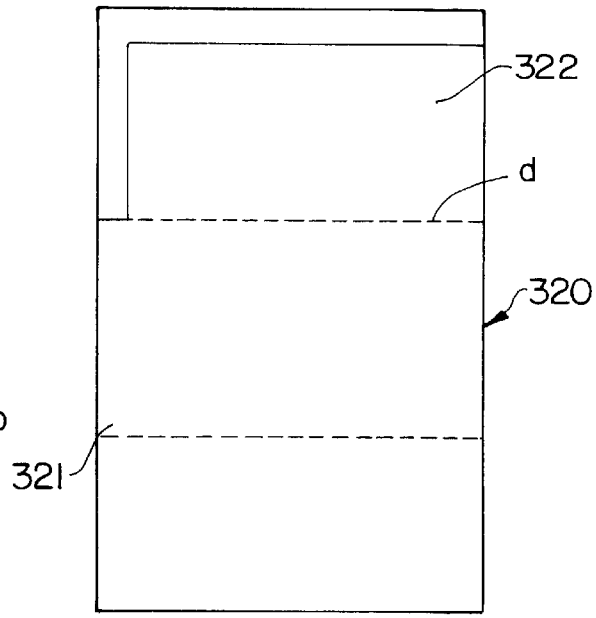
FIG. 32 is a plan view of a second variation of the embodiment of FIG. showing a middle section of the assembly having no margins such that the middle confirmation form hangs freely on the mail piece, attached only to the top mailing label section when placed on a mail piece.

Variants of this embodiment include a mailing form 310, as illustrated in FIG. 31, wherein the confirmation form 311 has confirmation tabs 312*a*, 312*b* on each side of the confirmation form 311 such that both sides of the confirmation form 311 can be separably adhered to the mailing piece (not shown). Alternatively, as illustrated in FIG. 32, mailing form 320 can be provided having a confirmation form 321 which has no confirmation tabs such that when the mailing form section 322 is applied and adhered to the mailing piece, the confirmation form is attached only by perforation line d and can be removed along perforation line d upon delivery.

Figure 33:
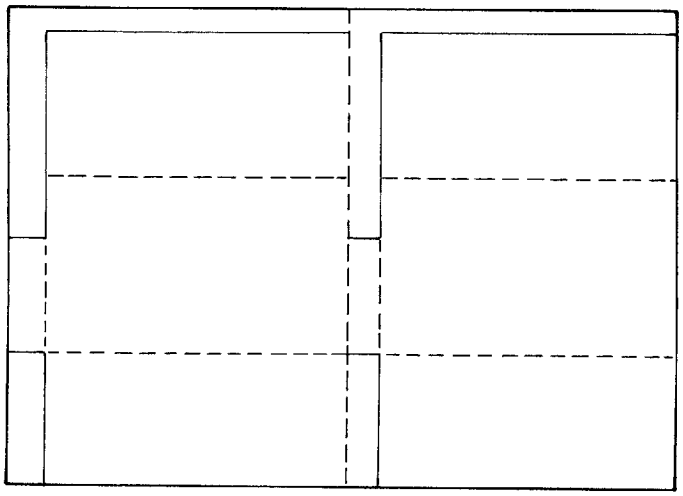
FIG. 33 is a plan view of a third variation of the embodiment of FIG. 25 showing a configuration whereby two assemblies are arranged on a single standard 8½"×11" or 8½"×12" (A4) size paper.
Figure 34:
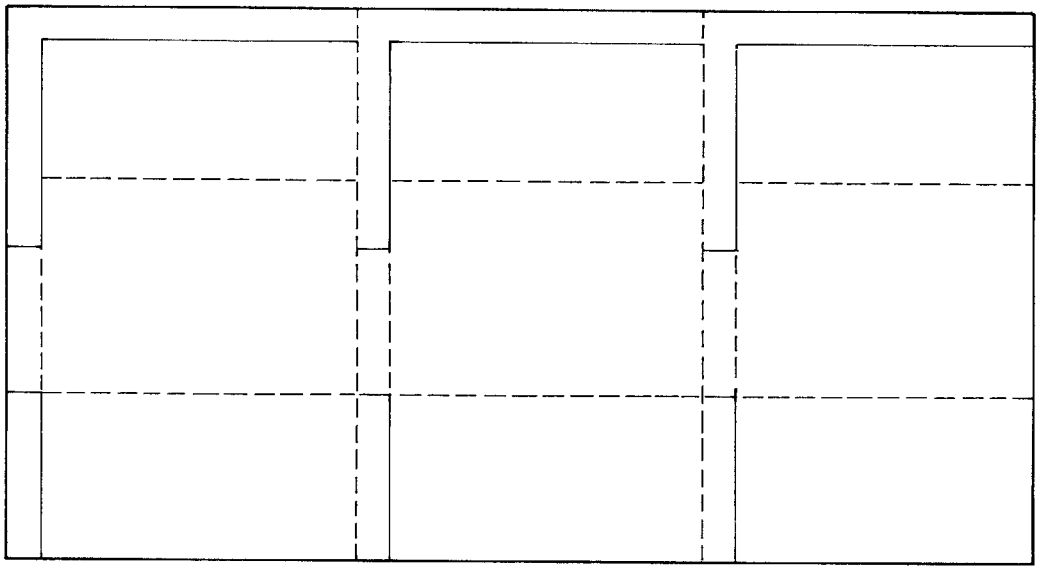
FIG. 34 is a plan view of a third variation of the embodiment of FIG. 25 showing a configuration whereby three assemblies are arranged on a single legal size paper.

In addition, the mailing forms can be configured to provide a plurality of forms on a single sheet. For example, as shown in FIG. 33, two mailing forms according to the subject invention can be placed side by side on a single sheet. Preferably, this "two-up" configuration can be provided on standard 8½"×11" or A4 size paper. A configuration showing a plurality of forms, specifically three forms placed side by side ("three-up) configuration, can also be provided. FIG. 34. This three-up configuration is preferably provided on legal size or 8½"×14" paper. Other multiple-form assemblies can be provided by increasing the size of the sheet, as would be understood by an ordinarily skilled artisan.

Figure 35:
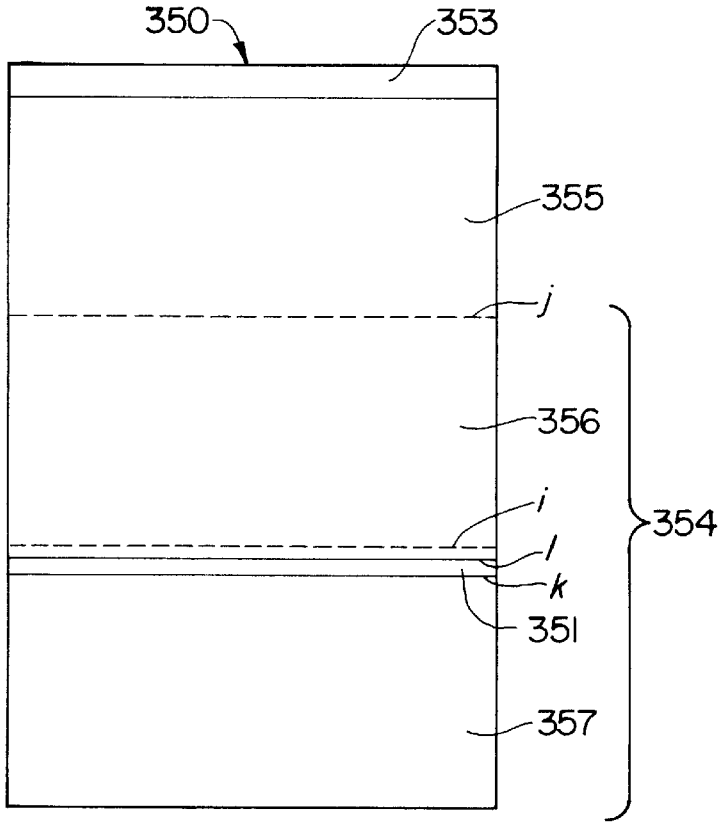
FIG. 35 is a plan view of a fourth variation of the embodiment of FIG. 25 showing a configuration whereby the configuration form has an adhering strip along its bottom edge for affixing the confirmation form to the package.
Figure 36:
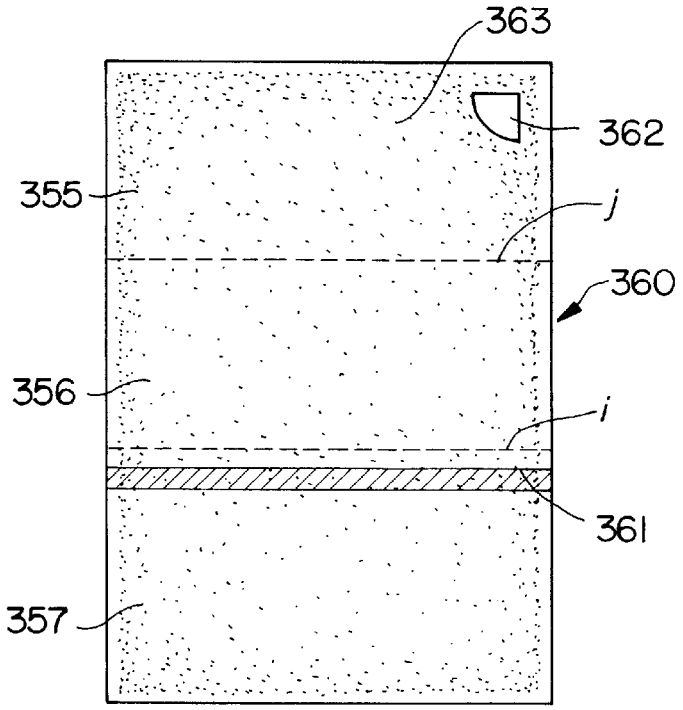
FIG. 36 shows a plan view of a back face of the front sheet of the variation shown in FIG. 35, illustrating patterned adhesive material and patterned adhesive release material disposed thereon.
Figure 37:
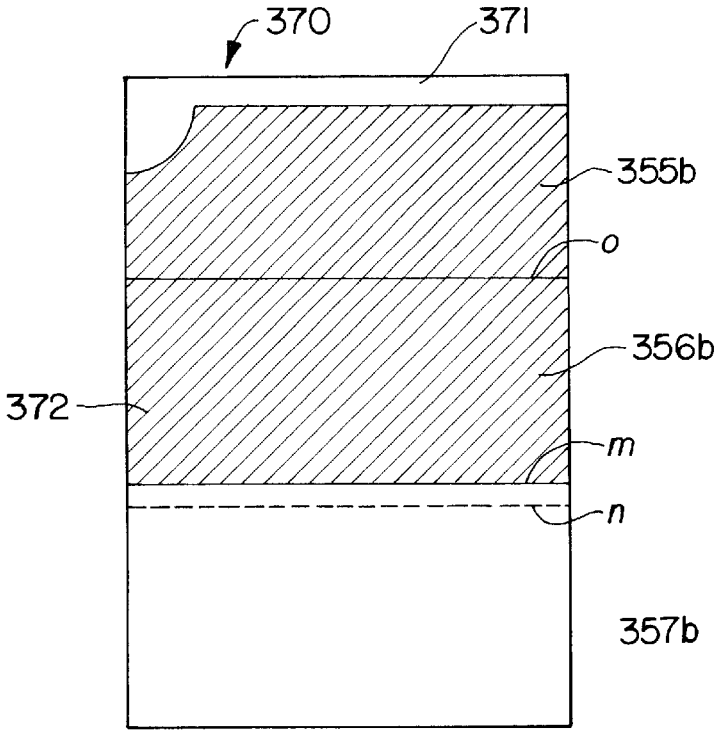
FIG. 37 shows a plan view of the front or interior face of the back sheet of the variation shown in FIG. 35.

A further variation of this embodiment, as shown in FIGS. 35–37 can be provided, wherein a confirmation tab is formed along a bottom edge of a duplex confirmation form when in folded configuration. The confirmation tab can be used to adhere the bottom edge of the duplex confirmation form to a mailing piece. Referring to FIG. 35, a mailing form assembly 350 is provided having a peel-away strip 351 on the front sheet below perforation line i which, when removed, exposes adhesive on the underlying sheet so that the duplex confirmation form 355 is adhered along its bottom edge (fold line 353 in duplex, or folded, configuration) to the mailing piece (not shown).

The peel-away border 353 extends along the entire top edge (width) of top mailing label section 355. Transverse perforations i, j extend across the width of the front sheet of assembly 350. Peel-away strip 351 is provided by die-cuts k, l through the front sheet of assembly 350. Die-cut I, which can also function as a fold line in forming the duplex confirmation form 354 (folding confirmation sheet 357 to meet confirmation sheet 356), is disposed midway between die-cut k and perforation i so that, when folded, die-cut k is superimposed behind perforation i. An area of adhesive release material 361 is disposed on an area corresponding to peel-away strip 351 on the back face of the front sheet (see FIG. 36). The back face of the front sheet otherwise can be coated or layered with adhesive material 363 substantially over the entire surface area except for a small adhesive-free "popout" area 362 to facilitate separation of the front and back sheets of mailing label section 355 (FIG. 35).

As shown in FIG. 37, the front face of back sheet 370 has release material 372 disposed substantially over the area corresponding to top mailing label section 355*b* and middle confirmation form section 356*b* of the back sheet. An adhesive-free and release-free border 371 remains so that the front sheet and back sheet permanently adhere in the border areas 353 (FIG. 35) and 371 (FIG. 37). A transverse perforation n is provided on the back sheet 370 superimposable to die-cut k on the front sheet. Die-cuts m, o are made in back sheet 370, corresponding to perforations i, j, respectively, of front sheet 350 to enable back sheet 355*b* to be peeled away from middle confirmation form section 356 of the overlying top sheet.

Significantly, die-cut m of back sheet 370 must be above (toward top label section) die-cut k of top sheet 350. The assembly would not remain functional or affixed together if die-cut m and die-cut k were superimposed or if die-cut m were formed on the back sheet 370 below die-cut k of front sheet 350.

In addition, the variation shown in FIGS. 35-37 differs from the variations shown in FIGS. 25-34 in that the gap for facilitating alignment and folding of the confirmation form into a duplex configuration is created not by providing an adhesive-free area above the fold line between the middle and bottom configuration sections, but rather, a strip of this backing sheet remains between perforation i and fold line I when the back sheets of top mailing section 355 and middle configuration section 356 are removed (as shown in Step E of FIG. 30).

The unitary embodiment of the mailing form according to the subject invention is shown in FIGS. 38–47. The unitary embodiment advantageously keeps each of the mailing label, confirmation form, and return receipt sections together during affixation of the mailing form to an envelope. Moreover, in a preferred embodiment, the mailing indicia and addressee information is provided in a single, unseparable or unitary section.

For proper application of mailing charges to a USPS account, a security code is provided in both the addressee label (in particular, the delivery point zip code) and the two dimensional barcode or indicia. These codes must match to prevent rejection by postal automated postal sorters/readers. Thus, keeping the addressee mailing label and mailing indicia sections as part of a unitary section within the mailing form can prevent mismatch of the security codes provided therein.

In addition, the subject unitary mailing form can be less labor intensive, requiring only two backing removal or processing steps for applying mailing labels to an envelope. In a preferred embodiment, the subject unitary mailing form embodiment can be provided on legal size paper.

Figure 38:
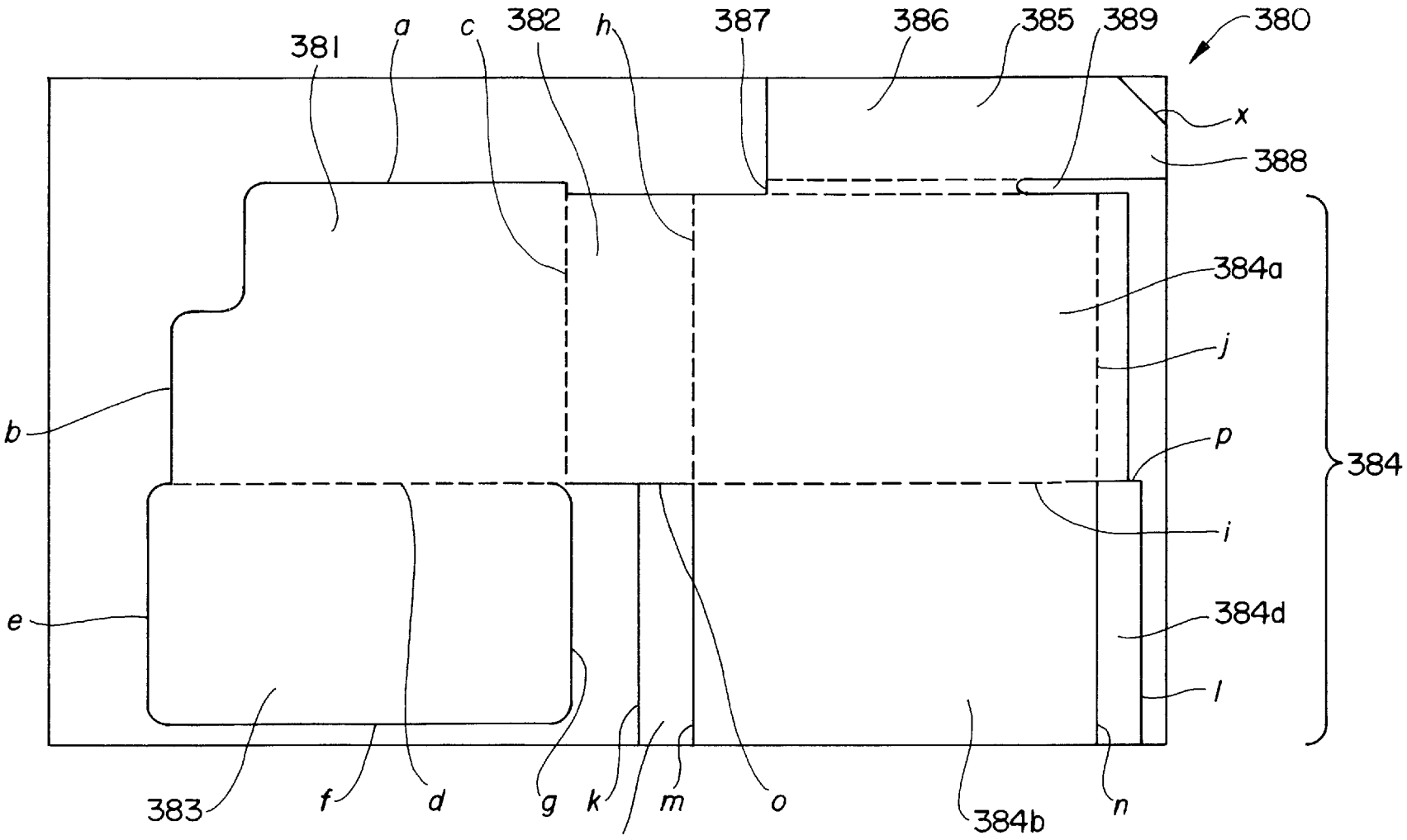
FIG. 38 shows a plan view of a front face of the front sheet of a first variation of a unitary embodiment of a mailing form according to the subject invention. Shown are die-cut lines and perforation lines for a certified mail embodiment of the subject mailing form.

Referring now to the figures, FIGS. 38–43 show a first variation of the unitary embodiment of the subject invention, preferably used in providing mailing information, postal indicia, a confirmation form, and a mailer's receipt for sending certified mail. Form 380 comprises a plurality of discrete sections which can be folded in place on an envelope in accordance with USPS requirements from a single connected form. Section 381, as shown in FIG. 38, comprises IBIP information; mailing indicia, including postage amount and two-dimensional bar code; as well as addressee information and one-dimensional barcode (coded delivery point ZIPcode) information in a single section. This mailing indicia/addressee information section has a die-cut around at least two edges intersecting one another and a perforated line on at least two other edges thereof.

The embodiment shown in FIG. 38 shows a stepped die-cut on the outermost edges of the mailing indicia/addressee information section 381. The right hand perforation c of this section forms a fold line which conforms to the right-hand edge of an envelope (not shown) and wraps around said right-hand edge. Connecting section 382 remains attached to section 381 at perforation line c and folds into position on the back side of the envelope. Perforation line d along mailing indicia/addressee information section 381 separates section 381 from receipt section 383 which can be torn away from section 381 along perforation line d. Mailer's receipt section 383 is shown having die-cuts e, f, g forming peel-away edges around at least three sides thereof. These peel away edges separate from the remainder of the backing sheet to provide a free hanging mailer's receipt having a retained backing sheet . Connecting section 382 further comprises perforation line h opposite and parallel to perforation line c. Perforation h further serves as one of a pair of tear away lines, along with perforation j, for releasably retaining confirmation form 384 in its duplex configuration. Confirmation form 384 is formed from top section 384*a* and bottom section 384*b*, which can be folded at fold line i such that the back faces of sections 384*a* and 384*b* are superimposed and adhered to one another. Confirmation tabs 384*c* and 384*d* are retained with confirmation form 384*b* in its folded configuration, detaching from the subject form at die-cuts k and l when forming a duplex confirmation form. The front sheet sections of confirmation tabs 384*c* and 384*d* form removable strips, separable along die-cuts k, l, m, n, o, and p from the back sheet portion corresponding thereto, which expose adhesive to affix the folded confirmation form 384 to the envelope.

Attached at the top edge of top confirmation form section 384*a* is the taggant/return address label 385 in an inverted configuration relative to the other mailing information provided on the subject form. The taggant portion 386 which is readable from the front face of the envelope comprises an extension 387 which folds over the top edge of the envelope. The return address information is provided on an integral portion 388 of the taggant/return address label 385, but is separated from the top confirmation form section 384*a* by space 389 which is equal in width to extension 387. FIG. 38 shows space 389 having a curvilinear juncture with extension 387, which can advantageously extend the life of a production die. However, it would be well accepted that other junctures can be formed therebetween. Also shown is die-cut x through the top sheet only, which is removable with the back sheet during the procedure of affixing the mailing label sections to an envelope.

Figure 39:
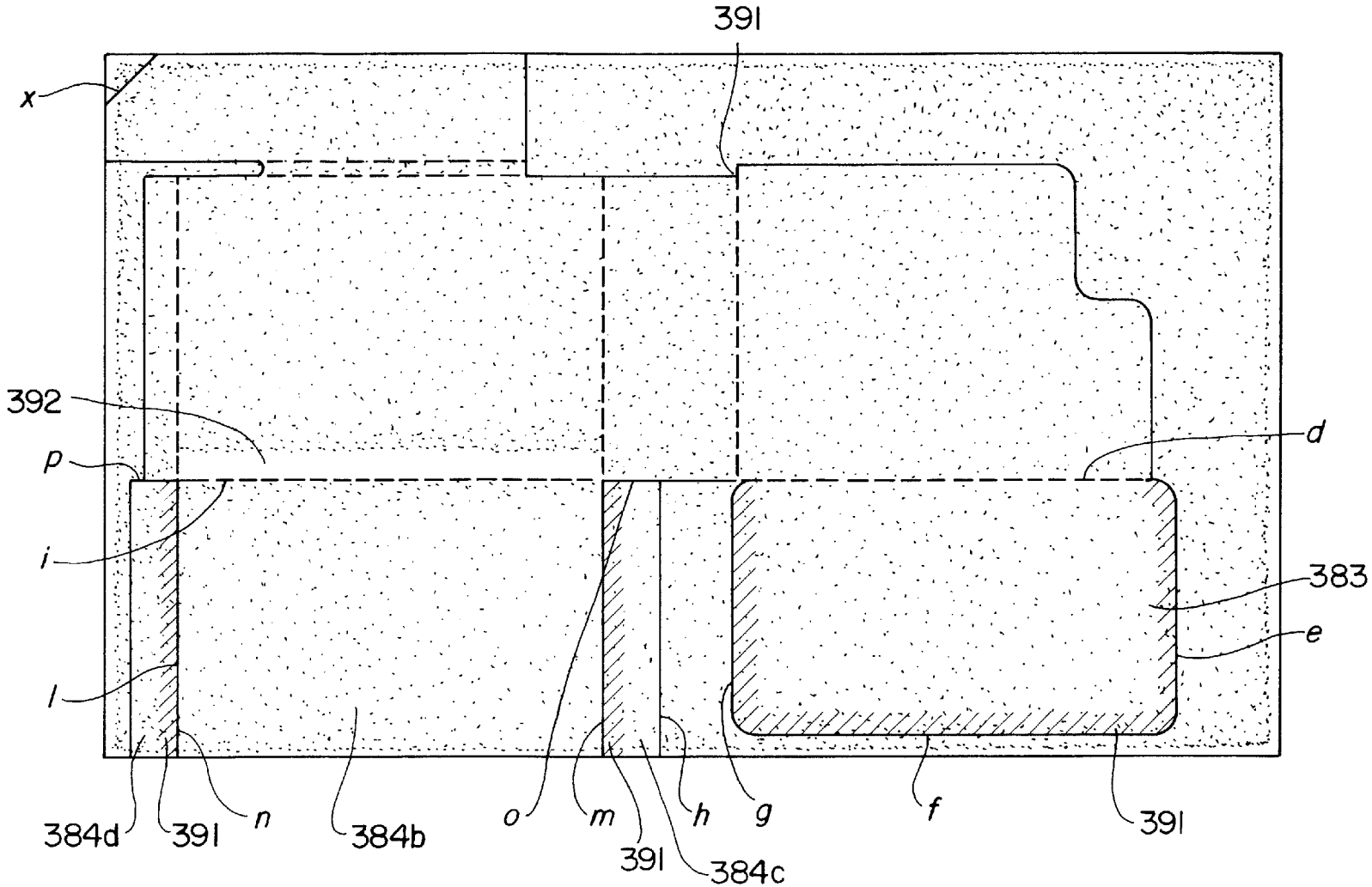
FIG. 39 shows a back face of the front sheet of the unitary embodiment shown in FIG. 38, illustrating adhesive material and adhesive release material patternly disposed thereon.

FIG. 39 illustrates the pattern of adhesive release material 391 disposed on the back face of the front sheet of form 380. Specifically, adhesive release material, e.g., silicon, is preferably disposed on the back face of confirmation tabs 384*c* and 384*d*. More preferably, adhesive release material is disposed the entire length of confirmation tabs 384*c* and 384*d*, i.e., from die-cuts o and p to the bottom of the sheet. However, adhesive release material is disposed only part of the width of tabs 384*c* and 384*d*, preferably about half their width, extending from die-cuts m and n. This allows adhesive to be exposed from the front face of bottom confirmation form section 384*b* in its folded configuration when strips 384*c* and 384*d* are removed in operation of the subject form. Adhesive release material is also preferably disposed around at least three borders of the back face of the front sheet corresponding to return receipt section 383. In a most preferred embodiment, adhesive release material is disposed on the back face of the front sheet to form an approximately ¼" inner border along die-cuts e, f, and g.

Adhesive material shown as dotted shading in FIG. 39, is disposed over substantially the entire surface area of the back face of the front sheet 380, except gap area 392 in a preferred embodiment, and an approximately ⅛"–1/16" border 394 around the perimeter of the front sheet of form 380. Gap area 392 preferably is an area extending between die-cuts m and n, above and proximate to perforation i. In the preferred embodiment, gap area 392 is approximately ¼" to ½" in width. This gap area 392 advantageously prevents initial adherence between confirmation form sections 382*a* and 384*b* when folding along fold line i, allowing the sections to be aligned before adhering them together to form the duplex confirmation form 384. Thus, it would be understood that gap area 392 can be omitted, i.e., having adhesive material being disposed in this area. The adhesive free border around the perimeter of the back face of the front sheet of form 380 is preferably provided to prevent hot-melt adhesive from oozing outside the edges of the form when exposed to heat during a printing operation using a laser printer.

FIG. 39 further shows the alignment guide 391 for aligning an envelope so that the label sections are correctly aligned and applied to the envelope according to USPS requirements. The alignment guide allows for proper alignment and application of mailing labels for any #8 through #11 standard envelope sizes. Preferably, the alignment guide provides intersecting lines wherein a top, right corner of an envelope can be placed for alignment therewith.

Figure 40:
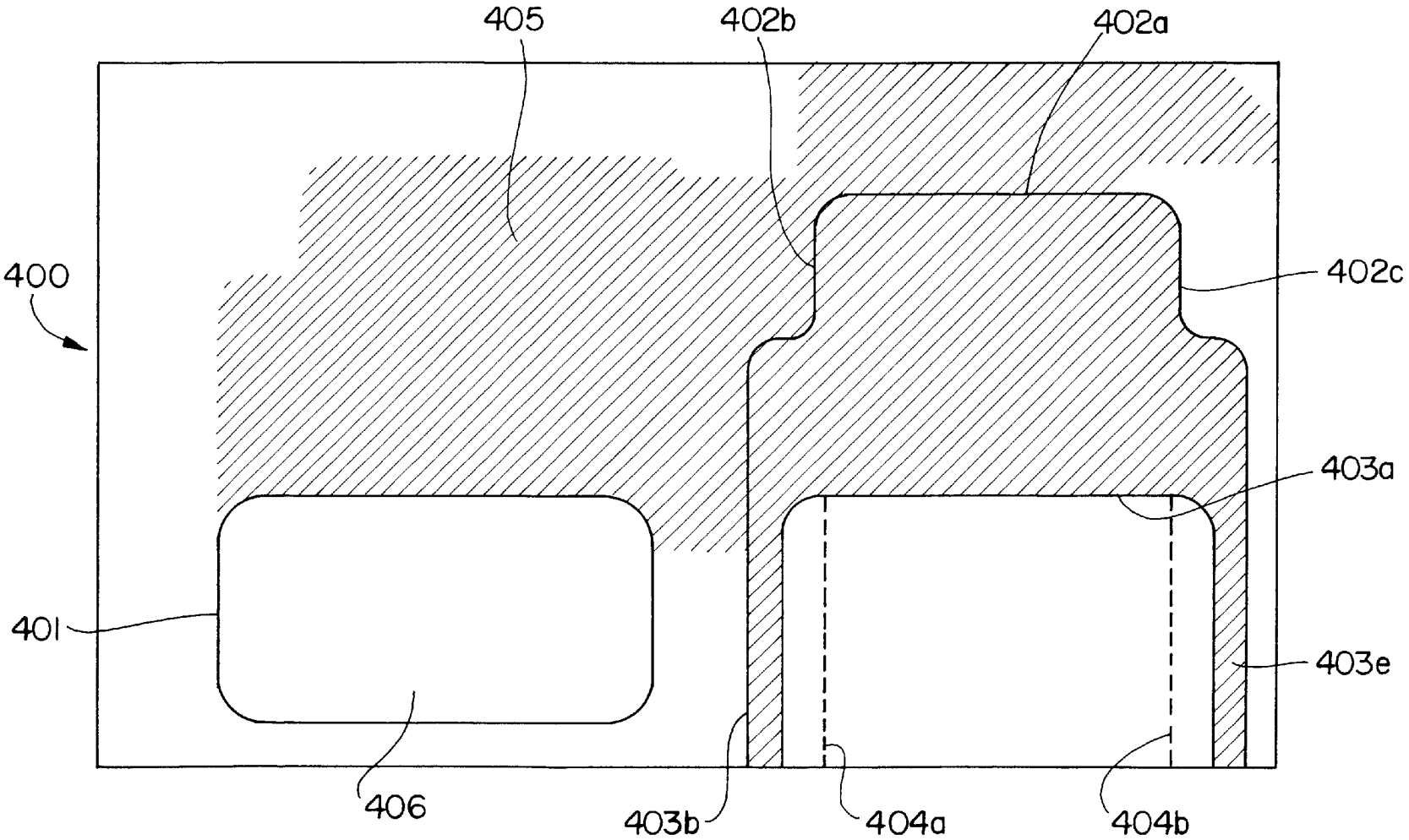
FIG. 40 shows a front face of the back sheet of the embodiment of FIG. 38, illustrating adhesive release material patternly disposed thereon.

As shown in FIG. 40, die-cuts can be provided in back sheet 400 for facilitating separation of certain sections from others of the back sheet. Specifically, a substantially rectangular die-cut 401 is made forming receipt backing section 406 which substantially conforms to the mailing receipt section 383 of the front sheet (FIG. 38). Preferably, die-cut 401 is slightly offset from the perimeter die-cuts or perforations of receipt section 383. Thus, rectangular section 406 is slightly smaller than the corresponding receipt section 383 formed on the front sheet. The offset configuration of die-cut 401 relative to the perimeter of receipt section 383 allows the subject form to retain its integrity, i.e., preventing complete separation of the formed section, during manufacture or printing operations. Die-cut 402*a* substantially conforms to the top edge of top confirmation form 384*a*. Die cuts 402*b* and 402*c* extend outside perforations h and j such that when this section of the back sheet is removed, adhesive backed tabs are formed on the outer side edges of top confirmation form 384*a*. Die-cuts 402*b* and 402*c* extend downward to form a shoulder such that the die-cut is then parallel to, but outside or offset from, die-cuts k and I of the front sheet of form 380. Die-cut 403*a*, and die-cuts 403*b* and 403*c* which are parallel to one another and perpendicularly intersecting with 403*a*, form three sides of a substantially rectangular area conforming to bottom confirmation form 384*b*. Die-cuts 403 b and 403*c* are parallel to, but offset from (preferably outside) die-cuts m and n of the front sheet. This offset configuration prevents die-cuts being made through both sheets whereby the formed sections completely separate from the form and destroy the integrity of the form. Offsetting the die-cuts allows for the back sheet and front sheet to support one another as a unitary substrate, i.e., producing a solid or unitary substrate which is fully supported in manufacturing and printing operations, including printing mailing indicia or information on a non-impact printer. Perforations 404*a* and 404*b* are also made in the back sheet conforming to die-cuts m and n on the front sheet, and which align with perforations h and j of the top confirmation form section 384 when the duplex confirmation form is formed.

Adhesive-release material is also disposed on the front, or inner, face of the back sheet of form 380, as shown in FIG. 40. Specifically, adhesive release material 405 is disposed in a pattern substantially conforming to particular mailing label sections shown in FIG. 38. Adhesive release material is patternly disposed conforming to the taggant/return address label section 385, including taggant 386, extension portion 387 and return address portion 388, but leaving a release-free area conforming to corner section 393 (FIG. 39). Adhesive release material is further disposed conforming to top confirmation form section 384*a*, connecting section 382 and mailing indicia/addressee section 381, extending slightly past and wrapping around the top of return receipt section 383. Adhesive release material is further disposed substantially behind tab sections 384*c* (but only between die-cuts 402*b* and 403*b*) and 384*d* (but only between die-cuts 403*c* and 402*c*.

Figure 41:
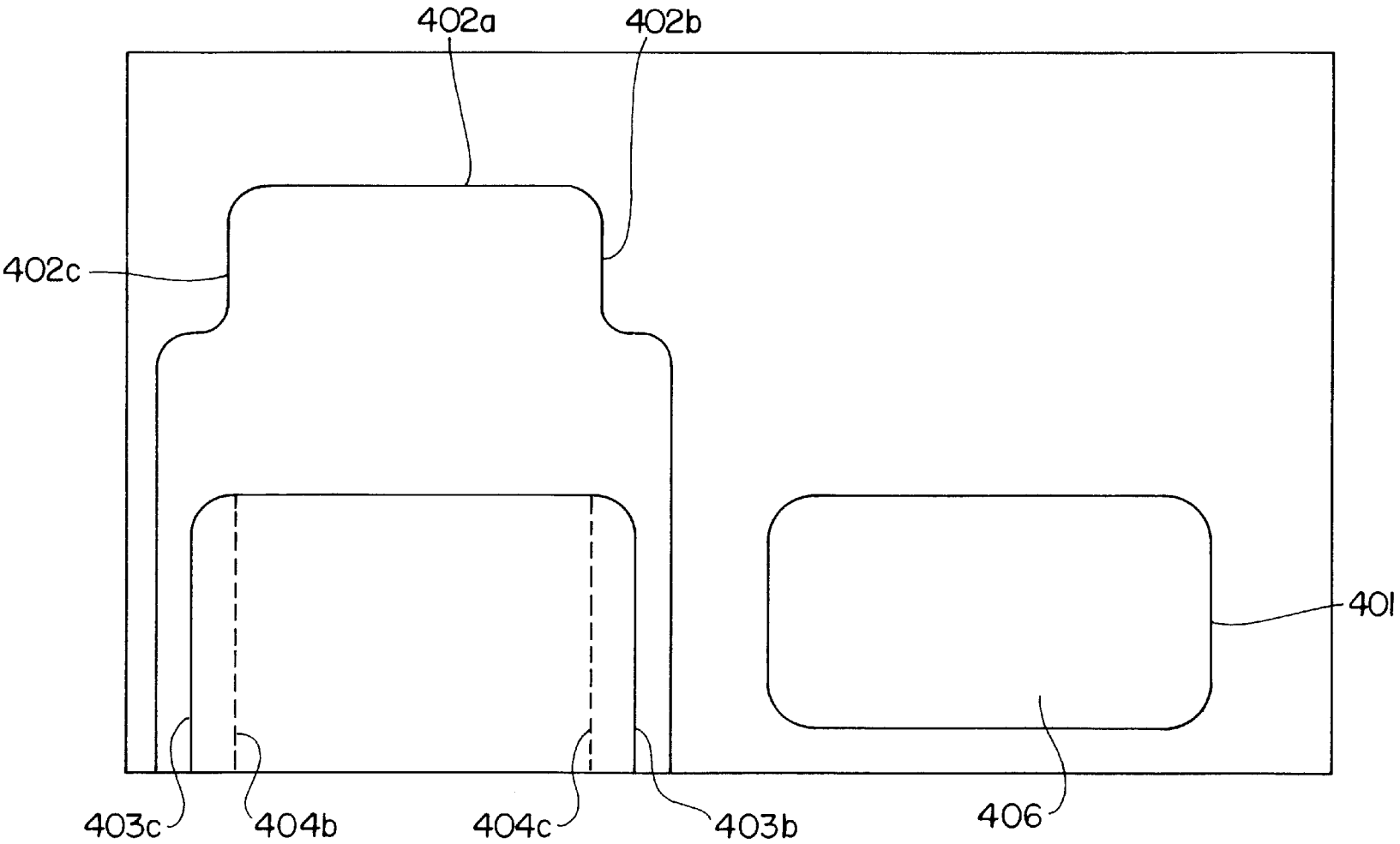
FIG. 41 shows a back face of the back sheet of the embodiment of FIG. 38, illustrating die-cuts and perforation lines for peeling, tearing, or folding of the subject mailing form.

The back face of the back sheet of form 380 is shown in FIG. 41, and illustrates die-cuts and perforation patterns conforming to those described for the front face of the back sheet.

Figure 42:
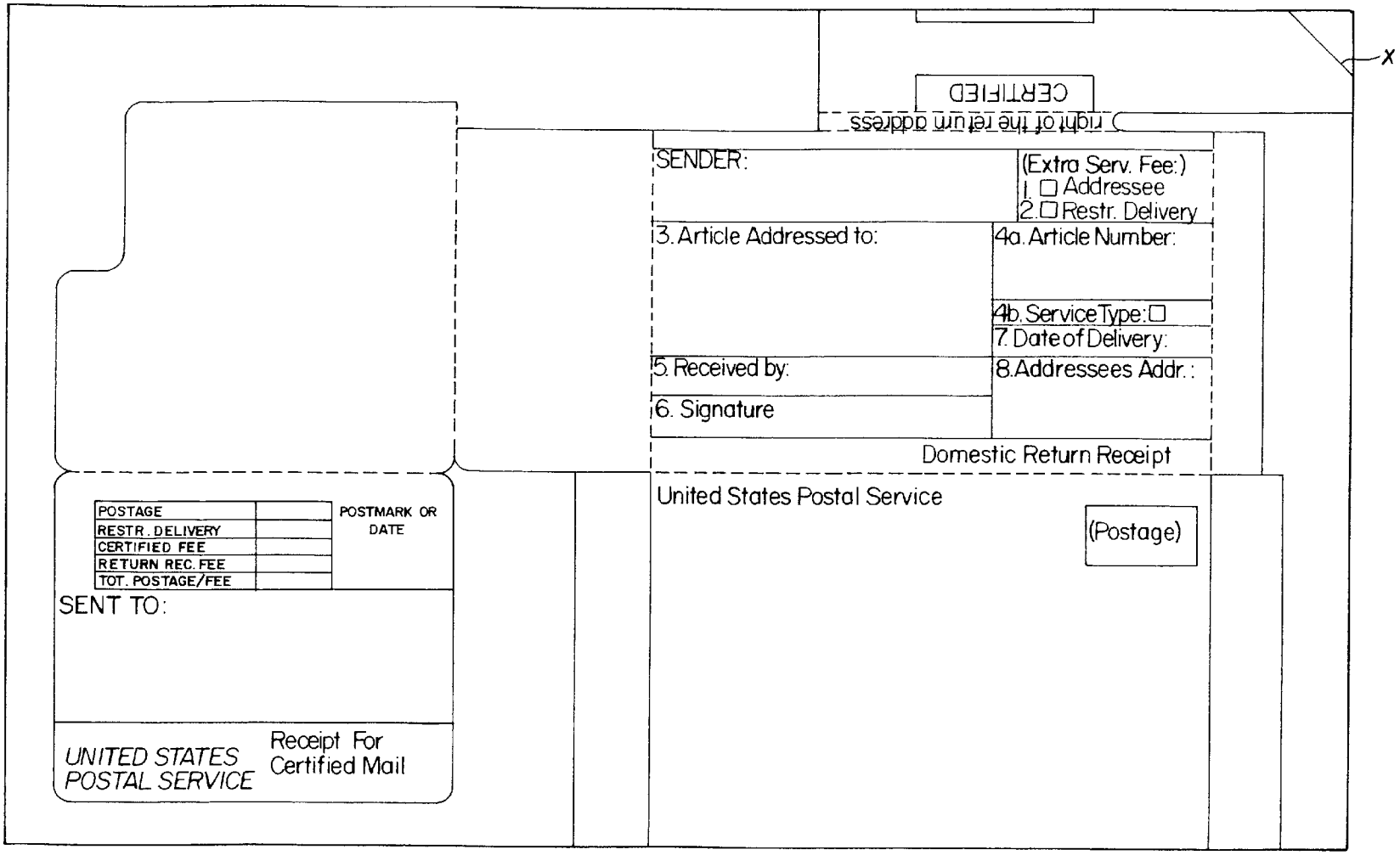
FIG. 42 shows the front face of the embodiment of FIG. 38, having information printed thereon in the manufacturing process.
Figure 43:
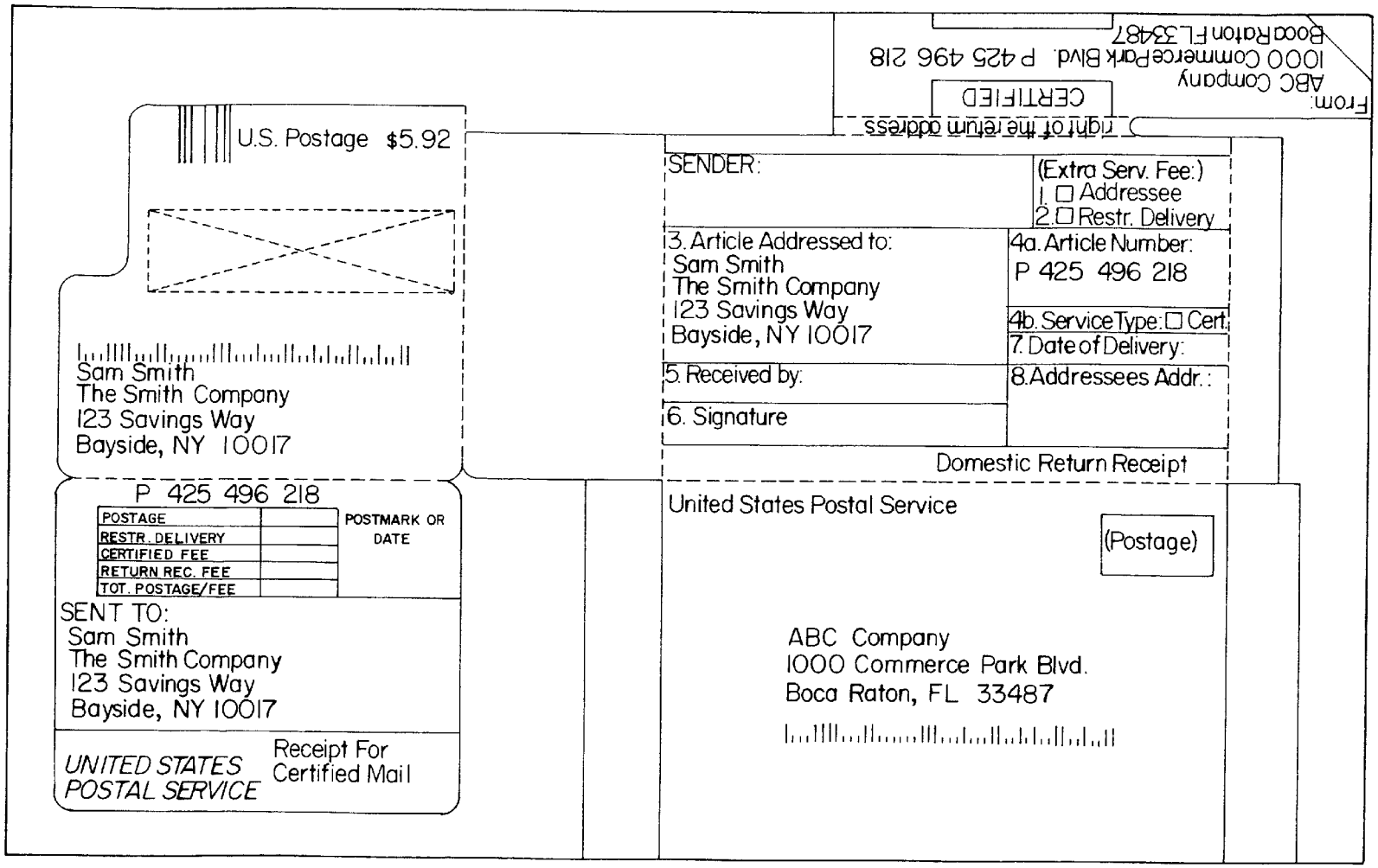
FIG. 43 shows the front face of the embodiment of FIG. 38, having mailing information and mailing indicia printed thereon by a non-impact printer.

FIGS. 42 and 43 show a front face of form 38 (certified mail variation) having mailing or instructional information printed thereon. FIG. 42 shows information which is printed on the form during the manufacturing procedure, and FIG. 43 shows the form 380 further having individualized mailing indicia and mailing information printed thereon by a non-impact printer.

A second variation of the unitary embodiment of the subject form, preferably used in providing mailing information or indicia, confirmation form, or mailer's receipt for registered mail is shown in FIGS. 44–49. In the registered mail variation of this embodiment, the mailing indicia/addressee information section, taggant/return address information, and confirmation forms, including both front and back sheets and adhesive or adhesive release material patterns are provided substantially identical to those of the certified mail variation and are thus not further described herein.

Figure 44:
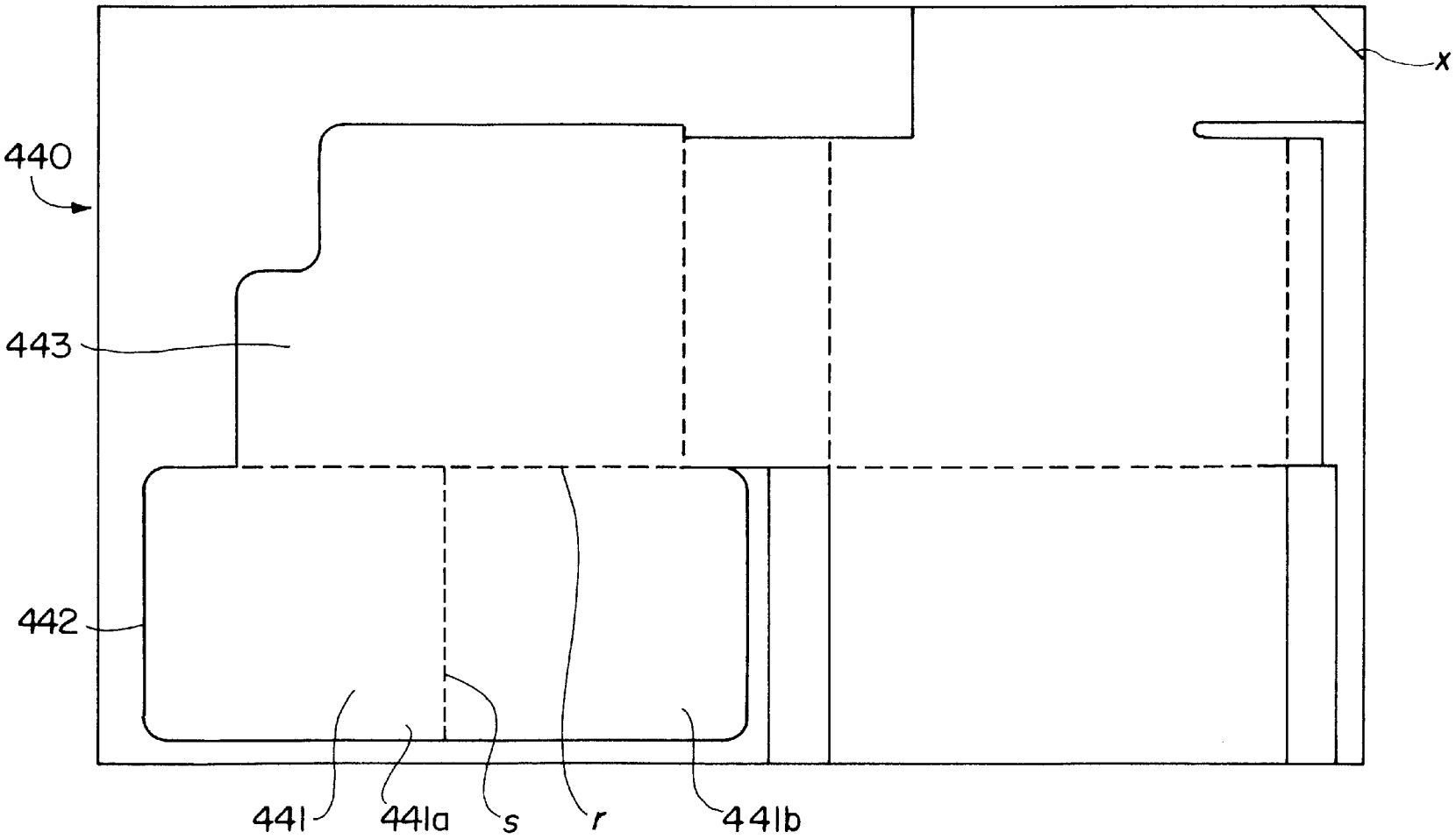
FIG. 44 shows a plan view of a front face of the front sheet of a second variation of a unitary embodiment of a mailing form according to the subject invention. Shown are die-cut lines and perforation lines for a registered mail embodiment of the subject mailing form having a dual mailer's receipt section.

As shown in FIG. 44, the registered mail variation of the subject form 440 provides a double configuration for the receipt section 441. The double receipt section 441 comprises a postal copy 441*a* of receipt section 441 and a mailer's copy 441*b* of receipt section 441. A die-cut 442 is preferably made around at least these sides of the substantially rectangular receipt section 441, and more preferably extends partially around a fourth (top) side thereof, coextensive with perforation r which removably divides receipt section 441 from mailing indicia/addressee information section 443.

Figure 45:
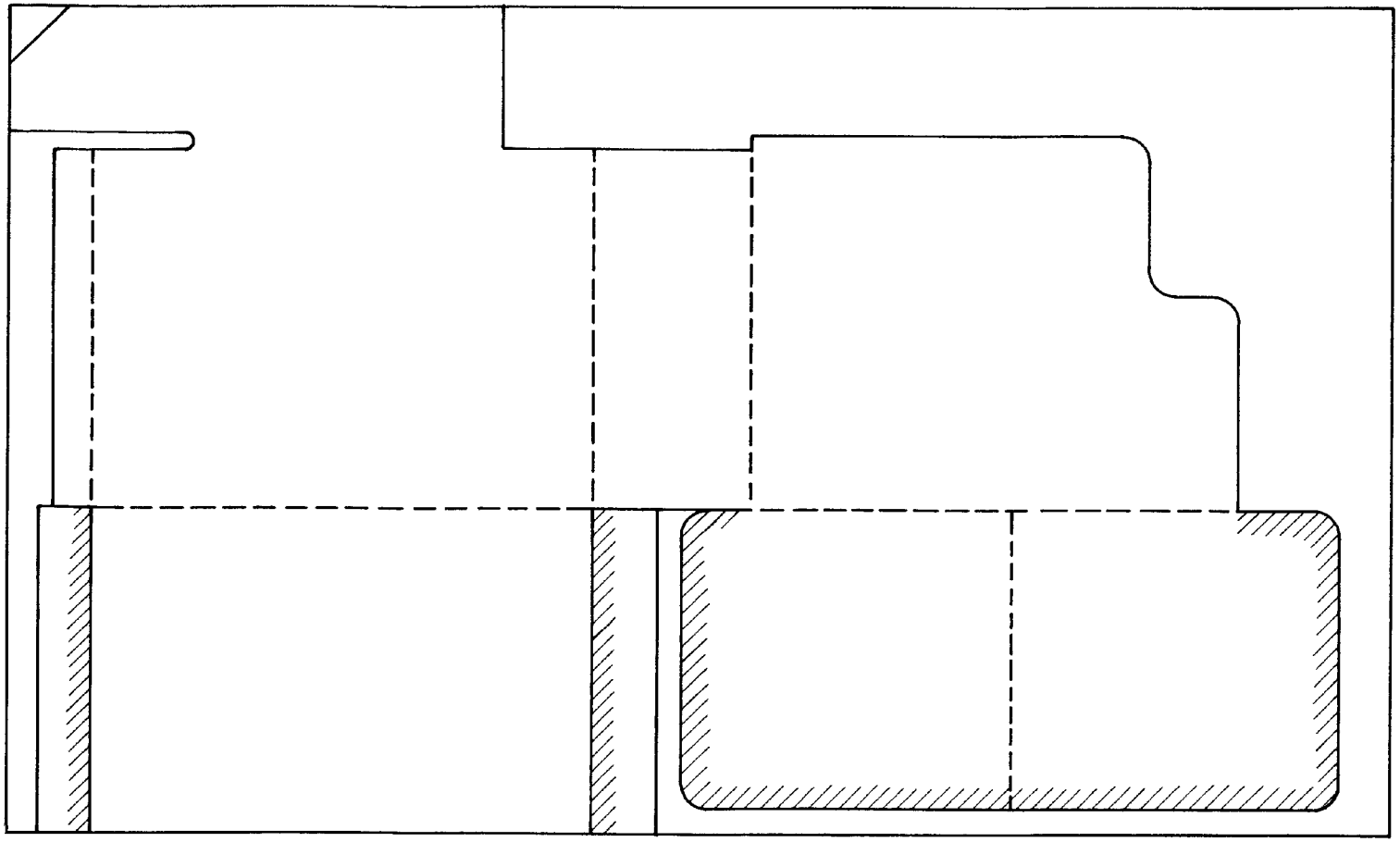
FIG. 45 shows a back face of the front sheet of the unitary embodiment shown in FIG. 44, illustrating adhesive release material patternly disposed thereon.
Figure 46:
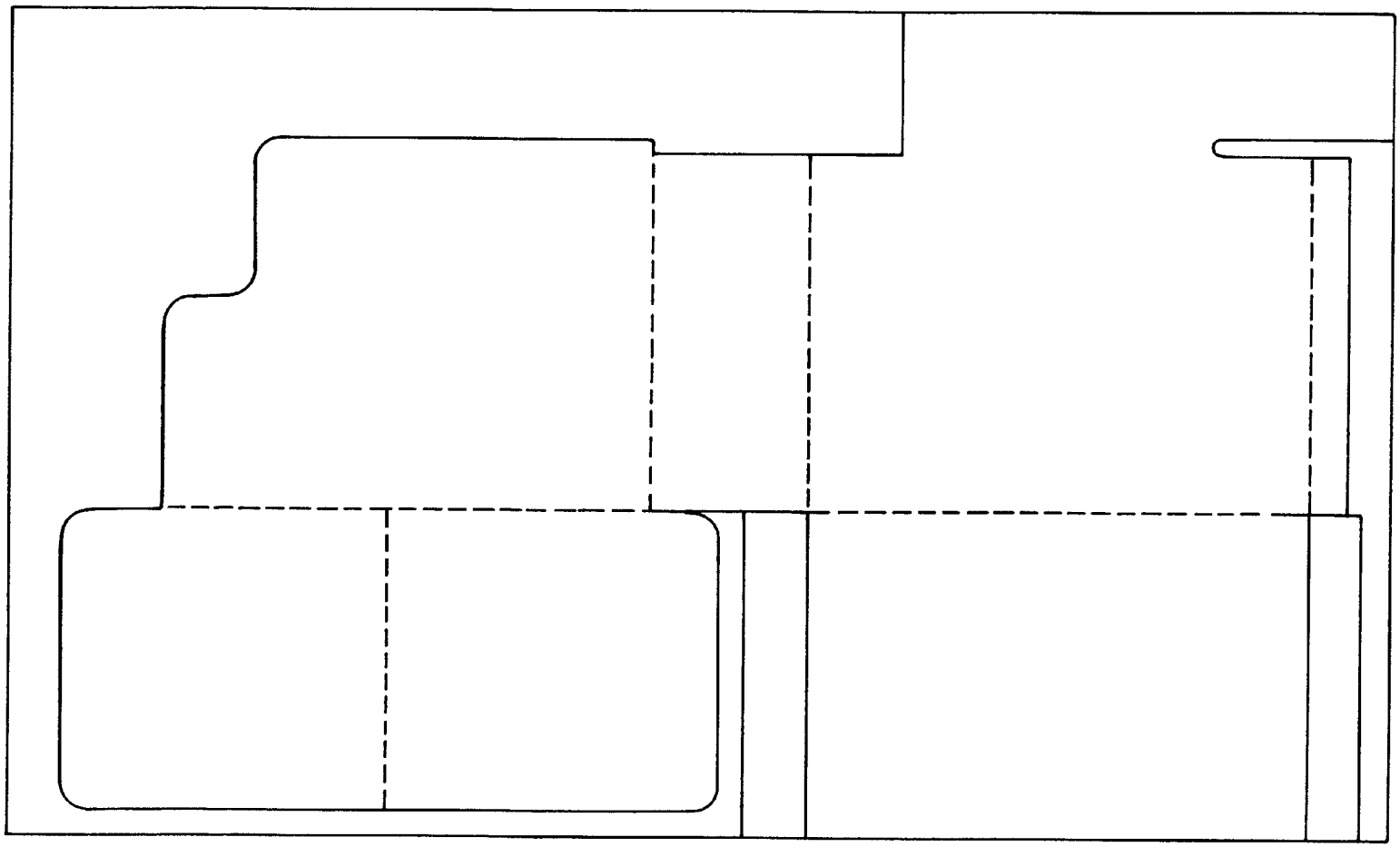
FIG. 46 shows a front face of the back sheet of the embodiment of FIG. 44, illustrating adhesive release material and adhesive material patternly disposed thereon.
Figure 47:
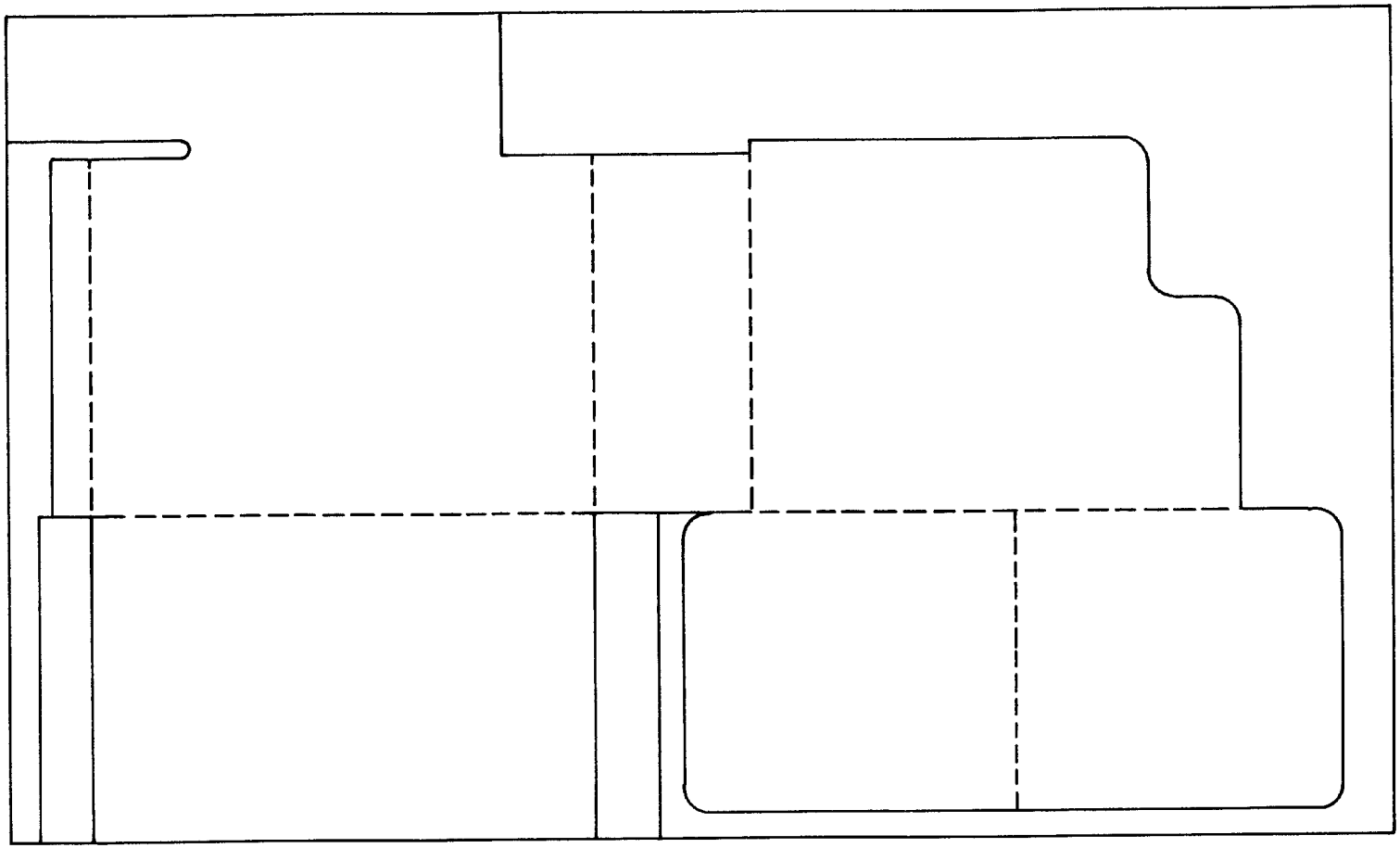
FIG. 47 shows a back face of the back sheet of the embodiment of FIG. 44, illustrating die-cuts and perforation lines for peeling, tearing, or folding of the subject mailing form.

Disposed between receipt sections 441*a* and 441*b* in a perforated embodiment is a vertical perforation s for separably connecting the two receipt sections 441*a* and 441*b*. Preferably, perforation s is disposed midway within receipt section 441 to form receipt section 441*a* and 441*b* of equal sizes. Alternatively, perforation s can be horizontally disposed to form on of the receipt copies connecting to the mailing indicia/addressee information section and disposed between that section and the second receipt copy. FIGS. 45–47 show the back face of the front sheet of form 440, the front face of the back sheet of form 440, and the back face of the back sheet of form 440, respectively.

These substantially conform to the FIGS. 39–41 of the first (certified mail) variation of the unitary embodiment of the subject invention, but adapted to provide the double receipt section as described.

Figure 48:
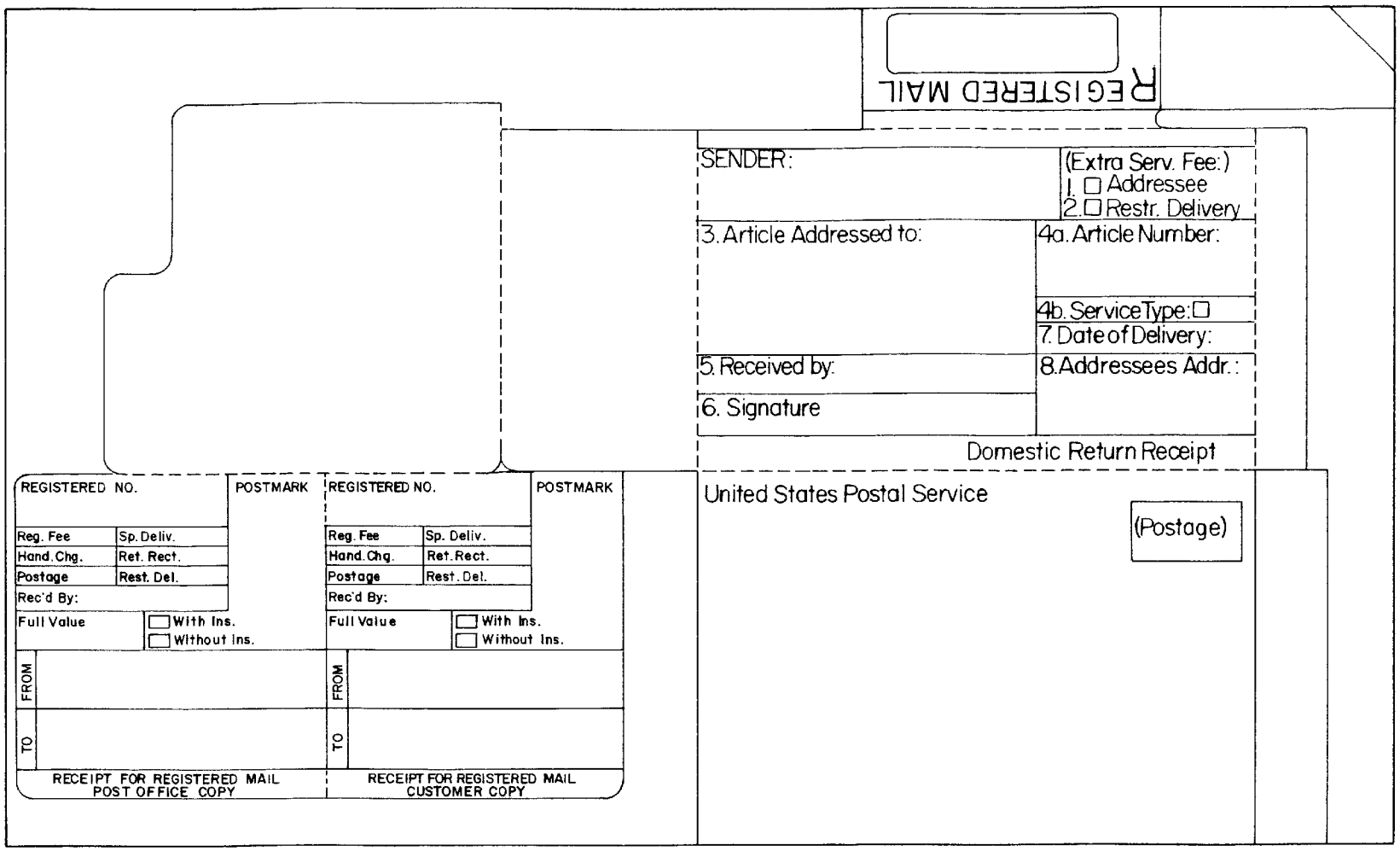
FIG. 48 shows the front face of the embodiment of FIG. 44, having information printed thereon in the manufacturing process.
Figure 49:
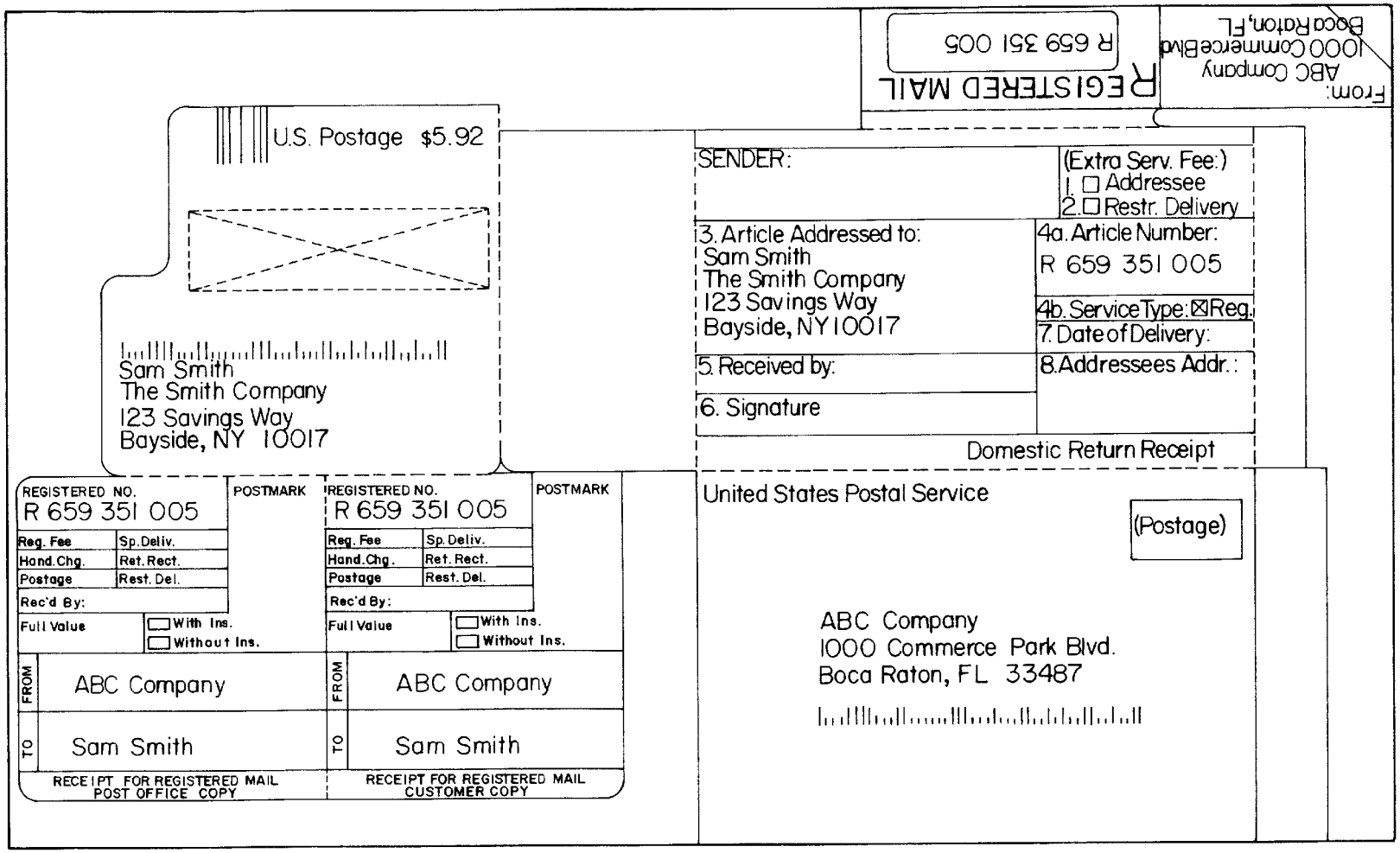
FIG. 49 shows the front face of the embodiment of FIG. 43, having mailing information printed thereon by a non-impact printer.

FIGS. 48 and 49 show a front face of form 440 (registered mail variation) having mailing or instructional information provided thereon. FIG. 48 shows information which is printed on the form during the manufacturing procedure, and FIG. 49 shows the form 440 further having individualized mailing indicia or information printed thereon by a non-impact printer.

Figure 50:
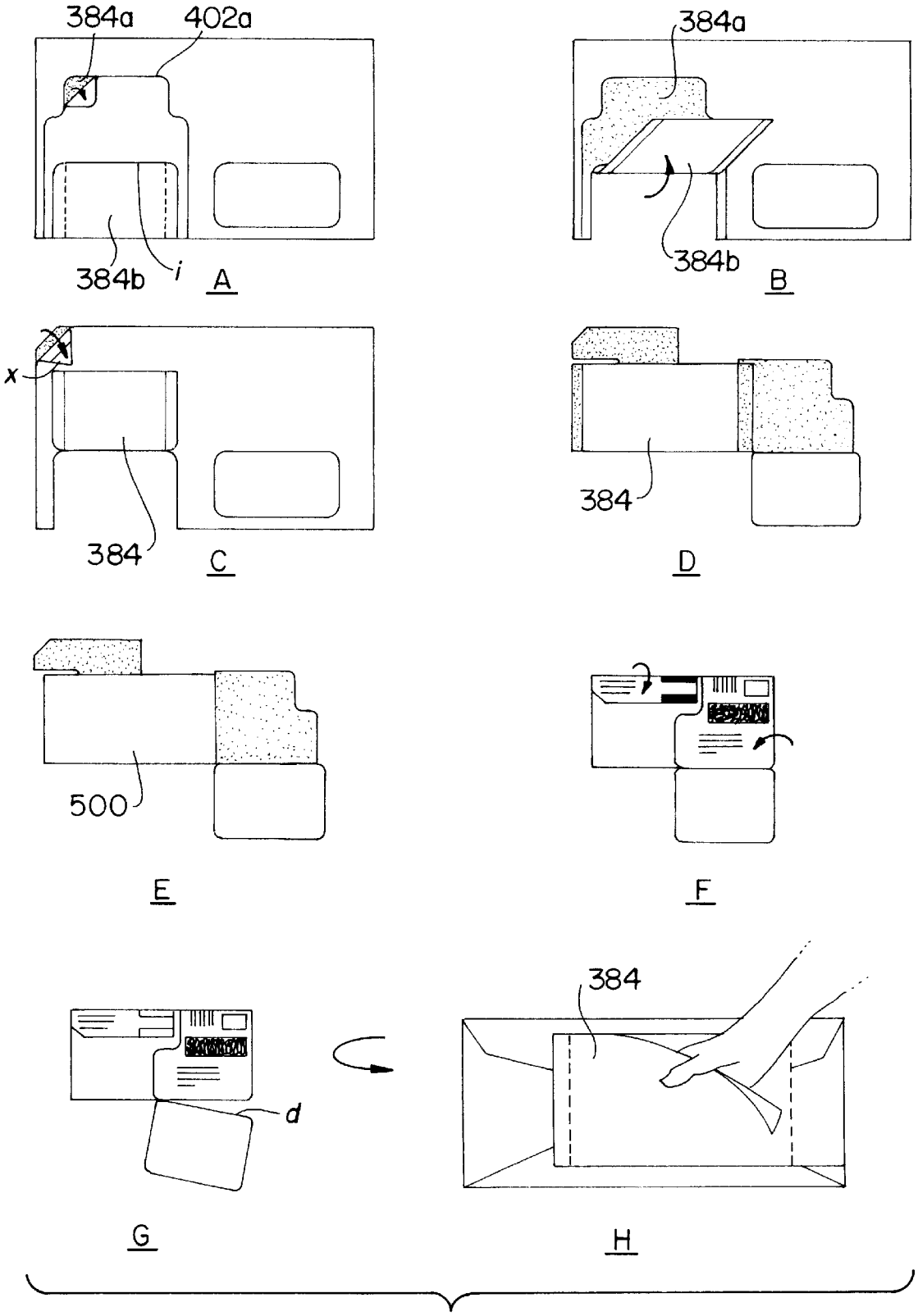
FIG. 50 shows a step-wise method of use for a unitary embodiment of the subject mailing form wherein discrete sections are affixed to an envelope in accordance with USPS requirements.

Use and application of the subject form is shown in step-wise fashion in FIG. 50. In operation of this embodiment, the form is fed through a non-impact printer to print mailing information and mailing indicia onto the front face of the front sheet of the form. In a first step A of applying the mailing information to an envelope using the subject form, a portion of the backing sheet outlined by die-cuts 402*a*, 402*b*, 402*c* 403*b* and 403*c* is removed to expose adhesive on the back face of a top section of the unfolded confirmation form 384*a*.

The bottom section 384*b* of the confirmation form is then folded over (step B) at fold line i and adhered to the exposed adhesive on the top confirmation form section 384*a*, forming a duplex confirmation form 384 (step C).

The balance of the backing sheet is then removed in a single step (step D) to expose adhesive disposed on the back face of the mailing indicia/addressee information section 381, the taggant/return address section 385, and tabs 384*c* and 384*d* bordering the right and left edges of the duplex confirmation form 384. The envelope 500, in step E, can then be placed in a face-up position at the alignment guide 391 so that the taggant/return address information and mailing indicia/addressee information sections can be folded over onto the front face of the envelope (step F) in conformance with USPS requirements. The mailing receipt tag 383, with the backing retained thereon, hangs freely at the bottom of the address information section (step G) for later removal at perforation d.

Tabs 384*c* and 384*d* adjacent to a side edge of the duplex confirmation form 384 remain affixed to the back side of said envelope 500 upon separation and removal of the confirmation form along tear-away perforations 404*b* and 404*c* (steps H and I).

An advantage of all these alternatives over the use of the form described in U.S. Pat. No. 4,683,792 to Walz is realized, in many applications, by the fact that the form of the present invention can easily be handled as a single sheet, instead of as a portion of a long, continuous pre-printed form having separable sections. Thus, for example, when a letter to be sent by certified mail is completed, the form can be simply loaded, as a single sheet, into a printer, for preparing the various forms needed for the certified mail process, including address information for the envelope. Most, if not all, printers used in word processing applications accept a single sheet manual loading in this way. At the same time, the program for generating the information for form may be accessed by the computer. When the single form is printed, the next job can be started. In other words, with the present invention, it is not necessary to accumulate information for a number of certified mail documents before beginning the printing of sections of the continuous form described by Walz.

Another significant advantage of each of the certified mail form embodiments described above is that the thickness of the form is substantially constant throughout. Other existing forms generally have different thickness for the postcard and remaining documents on the form and this differing thickness can cause jams in the feeding system of common printers.

While the use of a non-impact printer to provide variable information on the various forms described herein is particularly advantageous, it is to be understood that an impact printer could be used in a similar way. Generally, the invention has been described in its preferred form or embodiment with some degree of particularity, it is to be understood that this description has been given only by way of example and that numerous changes in the details of construction, fabrication and use, including the combination and arrangement of parts, may be made without departing from the spirit and scope of the invention.

I claim:

1. A unitary mailing form having discrete sections for printing mailing indicia or mailing information thereon by a non-impact printer, said form comprising a front sheet having die-cuts or perforations defining said discrete sections on which mailing information or mailing indicia are printed on a front face, a back face of the front sheet having adhesive material or adhesive release material patternly disposed thereon, a back sheet having die-cuts or perforations substantially conforming to the die-cuts or perforations of the front sheet, said back sheet having a front face on which adhesive release material is patternly disposed thereon, and a back face on which instructional information can be printed.

2. The mailing form of claim 1, wherein each discrete section is connected to at least one other discreet section.

3. The mailing form of claim 1, wherein mailing indicia and addressee information are printed on a single discrete section.

4. The mailing form of claim 1, wherein printed information is adapted for certified mail.

5. The mailing form of claim 1, wherein the printed information is adapted for registered mail.

6. The mailing form of claim 1, wherein said form has an envelope alignment guide for aligning an envelope so that the discrete sections are affixable to the envelope in accordance with United States Postal Service requirements.

7. The mailing form of claim 1, wherein one discrete section comprises IBIP indicia positionable on an envelope in accordance with United States Postal Service requirements.

8. The mailing form of claim 1, wherein one discrete section includes a taggant positionable on an envelope in accordance with United States Postal requirements.

9. The mailing form of claim 1, wherein the mailing form includes a discrete section which can be folded to form a duplex confirmation form.

10. The mailing form of claim 1, having a corner section formed by the front and back sheets adhered together which facilitates removal of the back sheet from the front sheet.

11. The mailing form of claim 1 wherein at least one die-cut of the front sheet and its substantially conforming die-cut on the back sheet are slightly offset such that the front sheet die-cut and back sheet die-cut are off-set such that said die-cuts are not superimposed to retain integrity of the form.

12. The mailing form of claim 1 wherein the mailing form is adapted for return receipt for merchandise mailing.

13. The unitary mailing form of claim 1 wherein said back sheet has adhesive release material coated substantially over its entire inner surface.

14. The mailing form of claim 3 wherein the mailing indicia and addressee information section folds along a non-die-cut fold line such that said section folds over a leading edge of an envelope to prevent jamming of a printer feed mechanism as the envelope is processed through a simplex printer.

15. The mailing form of claim 4, wherein one discrete section forms a mailer's receipt.

16. The mailing form of claim 5, wherein at least one discrete section forms a double receipt section separable by a perforation disposed therebetween.

17. The mailing form of claim 6 wherein said alignment guide guarantees automatic alignment or positioning of mailing indicia on the envelope in accordance with United States Postal Service requirements.

18. The mailing form of claim 11, wherein said offset die-cuts are on the confirmation form section of said mailing form.

* * * * *